US010593304B2

(12) United States Patent
Nakao

(10) Patent No.: US 10,593,304 B2
(45) Date of Patent: Mar. 17, 2020

(54) SIGNAL SUPPLY CIRCUIT AND DISPLAY DEVICE

(71) Applicant: Japan Display Inc., Minato-ku (JP)

(72) Inventor: Takayuki Nakao, Tokyo (JP)

(73) Assignee: Japan Display Inc., Minato-ku (JP)

( * ) Notice: Subject to any disclaimer, the term of this patent is extended or adjusted under 35 U.S.C. 154(b) by 22 days.

(21) Appl. No.: 15/611,244

(22) Filed: Jun. 1, 2017

(65) Prior Publication Data

US 2017/0352332 A1 Dec. 7, 2017

(30) Foreign Application Priority Data

Jun. 3, 2016 (JP) ..... 2016-112033

(51) Int. Cl.

*G09G 5/39* (2006.01)
*G09G 5/00* (2006.01)
*G09G 5/02* (2006.01)

(52) U.S. Cl.

CPC ..... *G09G 5/39* (2013.01); *G09G 5/005* (2013.01); *G09G 5/02* (2013.01); *G09G 2310/0294* (2013.01); *G09G 2360/02* (2013.01)

(58) Field of Classification Search

CPC ..... G09G 5/39; G09G 5/005; G09G 5/02; G09G 2310/0294; G09G 2360/02; G09G 5/026; G09G 5/028; G09G 5/04; G09G 2352/00; G09G 3/2033; G09G 3/2037; G09G 5/346; G09G 5/395; G09G 5/399; G09G 2370/045

See application file for complete search history.

(56) References Cited

U.S. PATENT DOCUMENTS 4,078,249 A * 3/1978 Lelke ..... B41B 27/00 341/22
4,149,184 A * 4/1979 Giddings ..... H04N 9/76 345/589
4,329,710 A * 5/1982 Taylor ..... B44D 3/003 348/701
4,471,377 A * 9/1984 Mogi ..... G09G 5/02 348/468
RE31,736 E * 11/1984 Mueller ..... G06T 17/00 345/549
4,504,827 A * 3/1985 Hanson ..... G09G 1/002 345/564
4,554,529 A * 11/1985 Moriyama ..... G11B 20/1426 341/95
4,563,677 A * 1/1986 Seiler ..... G09G 5/30 345/551

(Continued)

FOREIGN PATENT DOCUMENTS

JP 2013-186294 9/2013
JP 2014-186283 10/2014

*Primary Examiner* — Devona E Faulk
*Assistant Examiner* — Charles L Beard
(74) *Attorney, Agent, or Firm* — Oblon, McClelland, Maier & Neustadt, L.L.P.

(57) ABSTRACT

According to one embodiment, a signal supply circuit used for a display device includes a plurality of subpixels each including a memory. The signal supply circuit includes a first mode. The first mode receives first video data in a unit of n bits corresponding to the subpixels from outside, and supplies digital data for the subpixels in a unit of m bits less than n bits to the subpixels based on the first video data.

14 Claims, 26 Drawing Sheets

(56) References Cited

U.S. PATENT DOCUMENTS 4,580,135 A * 4/1986 Kummer ..... G09G 5/40 345/537
4,580,231 A * 4/1986 Tidd ..... B41B 27/00 715/202
4,581,721 A * 4/1986 Gunawardana ..... G06F 12/0215 365/230.09
4,631,531 A * 12/1986 Maeda ..... G09G 5/02 345/550
4,642,628 A * 2/1987 Murata ..... H04N 3/127 345/697
4,644,502 A * 2/1987 Kawashima ..... G09G 5/39 345/545
4,723,226 A * 2/1988 McDonough ..... G09G 5/39 345/519
4,745,462 A * 5/1988 Dischert ..... G09G 5/02 345/550
4,750,212 A * 6/1988 Yokomizo ..... H04N 1/3873 382/235
4,893,116 A * 1/1990 Henderson ..... G09G 5/022 345/591
4,979,094 A * 12/1990 Gemmell ..... A61F 4/00 340/4.11
4,982,279 A * 1/1991 Ishii ..... H04N 5/4448 348/553
4,985,698 A * 1/1991 Mano ..... G09G 3/3607 345/103
4,996,652 A * 2/1991 Morita ..... G09G 1/167 345/572
5,051,929 A * 9/1991 Tutt ..... G09G 5/02 345/428
5,142,637 A * 8/1992 Harlin ..... G09G 5/39 345/519
5,293,468 A * 3/1994 Nye ..... G09G 3/006 345/501
5,305,122 A * 4/1994 Hayashi ..... H04N 1/486 358/448
5,371,512 A * 12/1994 Otake ..... A63F 13/00 345/551
5,400,057 A * 3/1995 Yin ..... G09G 3/006 345/601
5,438,663 A * 8/1995 Matsumoto ..... G06F 3/14 345/503
5,511,229 A * 4/1996 Tsujimoto ..... G06F 13/4018 710/31
5,592,194 A * 1/1997 Nishikawa ..... G09G 3/3611 345/667
5,606,348 A * 2/1997 Chiu ..... G09G 5/006 345/213
5,767,831 A * 6/1998 Onishi ..... G09G 3/3611 345/103
5,784,044 A * 7/1998 Matsushiba ..... G09G 3/3611 345/629
5,856,816 A * 1/1999 Youn ..... G09G 3/3688 345/98
5,903,366 A * 5/1999 Hirabayashi ..... G06T 9/005 358/1.9
5,940,136 A * 8/1999 Abe ..... G09G 5/008 348/537
5,986,641 A * 11/1999 Shimamoto ..... G06F 3/1475 345/204
6,201,529 B1 * 3/2001 Shimizu ..... G06F 3/147 345/33
6,268,841 B1 * 7/2001 Cairns ..... G09G 3/2011 345/100
6,359,600 B1 * 3/2002 Mijnsbergen ..... G09G 3/20 345/3.3
6,535,187 B1 * 3/2003 Wood ..... G09G 3/22 345/204
6,603,465 B1 * 8/2003 Hashimoto ..... G05B 19/0423 345/204
6,621,478 B1 * 9/2003 Sakaguchi ..... G09G 3/3688 345/211
6,757,779 B1 * 6/2004 Nataraj ..... G11C 8/04 711/108
6,922,189 B2 * 7/2005 Fujiyoshi ..... G09G 3/3607 345/204
7,262,755 B2 * 8/2007 Mano ..... G09G 3/2011 345/88
7,515,161 B1 * 4/2009 Morgan ..... G09G 5/10 345/691
8,633,887 B2 * 1/2014 Lim ..... G09G 3/3688 345/100
2001/0010512 A1 * 8/2001 Azami ..... G09G 3/20 345/100
2001/0017618 A1 * 8/2001 Azami ..... G09G 3/3275 345/204
2001/0022565 A1 * 9/2001 Kimura ..... G09G 3/3266 345/82
2001/0030511 A1 * 10/2001 Yamazaki ..... G09G 3/3258 315/160
2001/0040564 A1 * 11/2001 Yun ..... G09G 3/20 345/204
2002/0024511 A1 * 2/2002 Ozawa ..... G09G 3/2011 345/204
2002/0033900 A1 * 3/2002 Honma ..... G09G 5/005 348/581
2002/0047555 A1 * 4/2002 Inukai ..... H01L 27/1214 315/169.3
2002/0093475 A1 * 7/2002 Hashimoto ..... G09G 3/3611 345/87
2002/0126106 A1 * 9/2002 Naito ..... G09G 3/3648 345/204
2002/0135313 A1 * 9/2002 Koyama ..... G09G 3/2022 315/169.3
2002/0196223 A1 * 12/2002 Takahashi ..... G09G 3/367 345/90
2003/0011548 A1 * 1/2003 Nakajima ..... G09G 3/2011 345/87
2003/0011581 A1 * 1/2003 Tanaka ..... G09G 3/3688 345/204
2003/0030614 A1 * 2/2003 Tajima ..... G09G 5/006 345/89
2003/0063077 A1 * 4/2003 Koyama ..... G09G 3/3233 345/204
2003/0088407 A1 * 5/2003 Hu ..... G06F 9/3879 704/223
2003/0107542 A1 * 6/2003 Abe ..... G09G 3/22 345/89
2003/0107543 A1 * 6/2003 Nakano ..... G09G 3/3607 345/90
2003/0145258 A1 * 7/2003 Warner ..... H04N 17/004 714/704
2003/0169247 A1 * 9/2003 Kawabe ..... G09G 3/342 345/204
2004/0046718 A1 * 3/2004 Osame ..... G09G 3/3275 345/80
2004/0150596 A1 * 8/2004 Uchida ..... G09G 3/3666 345/84
2004/0190092 A1 * 9/2004 Silverbrook ..... G06F 3/03545 358/539
2004/0233150 A1 * 11/2004 Guttag ..... G09G 3/34 345/87
2004/0252891 A1 * 12/2004 Sasaki ..... G09G 3/3688 382/232
2004/0257328 A1 * 12/2004 Lim ..... G09G 3/3688 345/100
2005/0017931 A1 * 1/2005 Toyoshima ..... G09G 3/325 345/76
2005/0088395 A1 * 4/2005 Chung ..... G09G 3/3655 345/98
2005/0099375 A1 * 5/2005 Moriyama ..... G09G 3/20 345/98
2005/0156838 A1 * 7/2005 Miyagawa ..... G09G 3/32 345/77
2005/0156862 A1 * 7/2005 Hirayama ..... G09G 3/3677 345/100
2005/0174306 A1 * 8/2005 Agari ..... G09G 3/3241 345/76

(56) References Cited

U.S. PATENT DOCUMENTS

2005/0206635 A1* 9/2005 Hashimoto ..... G09G 3/3614 345/204
2006/0012698 A1* 1/2006 Nitta ..... H04N 3/155 348/308
2006/0050044 A1* 3/2006 Ikeda ..... G09G 3/2096 345/98
2006/0066356 A1* 3/2006 Murata ..... H03M 9/00 326/93
2006/0139286 A1* 6/2006 Kida ..... G09G 3/3688 345/98
2006/0164364 A1* 7/2006 Murase ..... G09G 3/3685 345/98
2006/0181490 A1* 8/2006 Ozaki ..... G09G 3/2022 345/76
2006/0209952 A1* 9/2006 Tanizawa ..... H04N 19/176 375/240.03
2006/0277399 A1* 12/2006 Sakamaki ..... G06F 13/4013 712/300
2006/0284816 A1* 12/2006 Jang ..... G09G 3/3688 345/98
2007/0013614 A1* 1/2007 Oh ..... G09G 5/02 345/60
2007/0030192 A1* 2/2007 Son ..... G09G 3/20 341/156
2007/0044355 A1* 3/2007 Shofner ..... G09F 9/33 40/212
2007/0052861 A1* 3/2007 Osawa ..... H04N 9/67 348/649
2007/0076474 A1* 4/2007 Fujisawa ..... G11C 7/1012 365/185.03
2007/0080905 A1* 4/2007 Takahara ..... G09G 3/3233 345/76
2007/0180347 A1* 8/2007 Park ..... G09G 3/006 714/763
2008/0007508 A1* 1/2008 Yoneyama ..... G09G 5/005 345/100
2008/0022345 A1* 1/2008 Kim ..... H04N 7/163 725/131
2008/0122810 A1* 5/2008 Murase ..... G09G 3/3685 345/204
2008/0122855 A1* 5/2008 Sonoyama ..... G09G 3/20 345/531
2008/0174348 A1* 7/2008 Yazdy ..... H04N 1/053 327/157
2008/0174794 A1* 7/2008 Yazdy ..... B41J 2/47 358/1.7
2008/0218373 A1* 9/2008 Lanigan ..... G07C 9/00182 340/5.1
2008/0238845 A1* 10/2008 Kanou ..... G09G 3/3607 345/87
2008/0265785 A1* 10/2008 Kim ..... G09G 3/3225 315/169.3
2008/0303767 A1* 12/2008 Ludden ..... G09G 3/3688 345/89
2008/0303836 A1* 12/2008 Ludden ..... G09G 3/2092 345/531
2009/0091524 A1* 4/2009 Lomas ..... G09G 3/3611 345/87
2009/0167379 A1* 7/2009 Mobin ..... H03L 7/0812 327/149
2009/0189924 A1* 7/2009 Ogura ..... G09G 3/3233 345/690
2009/0231268 A1* 9/2009 Yamada ..... G02F 1/167 345/107
2009/0267965 A1* 10/2009 Han ..... G09G 3/3607 345/690
2009/0303219 A1* 12/2009 Kimura ..... G09G 3/3688 345/211
2010/0097340 A1* 4/2010 Mizuhashi ..... G06F 3/0412 345/173
2010/0103201 A1* 4/2010 Nakanishi ..... G09G 3/2003 345/690
2010/0128019 A1* 5/2010 Harada ..... G06F 3/147 345/212
2010/0226495 A1* 9/2010 Kelly ..... G11B 20/00086 380/30
2010/0282945 A1* 11/2010 Yokogawa ..... H01L 27/14621 250/208.1
2010/0295841 A1* 11/2010 Matsuda ..... G09G 3/3674 345/213
2010/0309173 A1* 12/2010 Matsuda ..... G09G 3/3674 345/204
2010/0315388 A1* 12/2010 Fan ..... G09G 3/20 345/204
2010/0321413 A1* 12/2010 Weng ..... G09G 3/3688 345/690
2011/0025654 A1* 2/2011 Nishimura ..... H03F 3/3022 345/204
2011/0050746 A1* 3/2011 Tsuchi ..... G09G 3/20 345/690
2011/0063330 A1* 3/2011 Bae ..... G09G 3/3413 345/690
2011/0122122 A1* 5/2011 Chen ..... G09G 3/3688 345/213
2011/0148954 A1* 6/2011 Tobita ..... G09G 3/3688 345/698
2011/0172808 A1* 7/2011 Fu ..... G07D 11/30 700/215
2011/0181556 A1* 7/2011 Sakai ..... G09G 3/3685 345/204
2011/0267323 A1* 11/2011 Fujikawa ..... G09G 3/3648 345/206
2012/0001892 A1* 1/2012 Kojima ..... H03F 3/3022 345/212
2012/0044202 A1* 2/2012 Ishizaki ..... G02F 1/13338 345/174
2012/0056870 A1* 3/2012 Koh ..... G09G 3/20 345/215
2012/0086677 A1* 4/2012 Lin ..... G09G 3/20 345/204
2012/0120040 A1* 5/2012 Ogawa ..... G09G 3/3688 345/208
2012/0127369 A1* 5/2012 Shimada ..... H04N 5/142 348/584
2012/0154727 A1* 6/2012 Chang ..... G02F 1/133707 349/129
2012/0229319 A1* 9/2012 Takahashi ..... H03M 1/007 341/155
2012/0229483 A1* 9/2012 Li ..... G09G 3/20 345/531
2012/0274493 A1* 11/2012 Yang ..... H03M 1/108 341/120
2013/0027279 A1* 1/2013 Peacock ..... G06F 3/1446 345/1.3
2013/0082604 A1* 4/2013 Williams ..... H05B 33/0827 315/130
2013/0083083 A1* 4/2013 Woo ..... G09G 3/3208 345/690
2013/0106804 A1* 5/2013 John ..... H03M 9/00 345/204
2013/0229403 A1* 9/2013 Teranishi ..... G09G 3/3607 345/212
2014/0183481 A1* 7/2014 Lee ..... H01L 27/3213 257/40
2014/0232706 A1* 8/2014 Iwasa ..... G02F 1/136213 345/206
2014/0240457 A1* 8/2014 Xia ..... H04N 13/15 348/43
2014/0267200 A1* 9/2014 Iwasa ..... G09G 3/006 345/204
2014/0267272 A1* 9/2014 Ossowski ..... G06T 1/20 345/426
2014/0285761 A1 9/2014 Tamaki et al.
2014/0320477 A1* 10/2014 Izawa ..... G09G 3/2022 345/212
2014/0320482 A1* 10/2014 Kawanaka ..... G09G 3/3659 345/214

(56) References Cited

U.S. PATENT DOCUMENTS

2014/0340383 A1* 11/2014 Gyouten ..... G09G 3/3696 345/212
2014/0368477 A1* 12/2014 Huang ..... G09G 3/20 345/204
2015/0103909 A1* 4/2015 Pandey ..... H04N 19/503 375/240.13
2015/0302803 A1* 10/2015 Aoki ..... G09G 3/3291 345/212
2015/0332640 A1* 11/2015 Liao ..... H04N 13/356 345/694
2016/0014415 A1* 1/2016 Wu ..... H04N 19/103 375/240.24
2016/0063928 A1* 3/2016 Sakaigawa ..... G09G 3/3406 345/690
2016/0284320 A1* 9/2016 Akaishi ..... G09G 5/36
2016/0334664 A1* 11/2016 Zhuang ..... H01L 27/124
2016/0351099 A1* 12/2016 Kim ..... G09G 3/2037
2017/0069279 A1* 3/2017 Hayashi ..... G09G 3/3614
2017/0076692 A1* 3/2017 Miura ..... G09G 3/3685
2017/0104948 A1* 4/2017 Shem ..... H04N 5/378
2017/0111071 A1* 4/2017 Yoo ..... H04L 25/03146
2017/0179160 A1* 6/2017 Takahashi ..... H01L 27/1225
2017/0193892 A1* 7/2017 Ha ..... G09G 3/2092
2017/0200407 A1* 7/2017 Nakao ..... G09G 3/2003
2017/0201693 A1* 7/2017 Sugizaki ..... H04N 5/355
2017/0263197 A1* 9/2017 Zhu ..... G09G 3/2074
2017/0352332 A1* 12/2017 Nakao ..... G09G 5/39
2018/0025692 A1* 1/2018 Yata ..... G02F 1/133514 345/694
2018/0061307 A1* 3/2018 Inoue ..... G09G 3/3275
2018/0061344 A1* 3/2018 Kurokawa ..... G09G 3/3233
2018/0103301 A1* 4/2018 Strein ..... H04N 21/64322
2018/0204515 A1* 7/2018 Hwang ..... G09G 3/3258
2018/0232056 A1* 8/2018 Nigam ..... G06F 3/167
2019/0114985 A1* 4/2019 Yokoyama ..... G09G 3/3677

* cited by examiner

SIGNAL SUPPLY CIRCUIT AND DISPLAY DEVICE

CROSS-REFERENCE TO RELATED APPLICATIONS

This application is based upon and claims the benefit of priority from Japanese Patent Application No. 2016-112033, filed Jun. 3, 2016, the entire contents of which are incorporated herein by reference.

FIELD

Embodiments described herein relate generally to a signal supply circuit and a display device.

BACKGROUND

A liquid crystal display device includes a control device and a display panel. In the display area of the display panel, basically, a plurality of pixels are arranged in a row direction (X-direction) and a column direction (Y-direction). The X-direction intersects the Y-direction. In recent years, various types of display panels have been available to consumers. The display panels are broadly divided into display panels which perform monochrome display (monochrome display panels) and display panels which perform color display (color display panels). Some monochrome display panels can perform gradation display. However, other monochrome display panels cannot perform gradation display. Some color display panels comprise a red (R) filter, a green (G) filter and a blue (B) filter as color filters. Other color display panels comprise a white (W) filter in addition to a red (R) filter, a green (G) filter and a blue (B) filter.

The dot display units of display panels are realized by pixels. The dot display pixels of monochrome display panels are simply referred to as pixels (or monochrome pixels). The dot display pixels of color display panels are referred to as subpixels. To display various colors, some color display panels comprise a red (R) subpixel, a green (G) subpixel and a blue (B) subpixel. Other color display panels comprise an R subpixel, a G subpixel, a B subpixel and a white (W) subpixel.

The use efficiency of light of W subpixels is higher than that of R, G and B subpixels. The transmittance of W subpixels is approximately three times that of R, G and B subpixels. Thus, the brightness of the display panel can be increased by using W subpixels.

Many external devices which supply video data (in other words, image data) to a liquid crystal display device output R, G and B video data items. In the future, various types of external devices will appear. For example, an external device may output monochrome video data as video data. Another external device may output R, G, B and dummy video data items.

As described above, various types of external devices and display panels will be present in the coming years. When a system for loading video data from an external device and displaying the data in a liquid crystal display device is designed, the type of one of the external device and a display panel is determined by the type of the other one of the external device and the display panel.

However, if the system is designed in the above manner, the finished system lacks flexibility. For example, when the external device is replaced by a new one, the new external device may not conform to the display panel of the liquid crystal display device. Conversely, when the liquid crystal display device is replaced by a new one, the new liquid crystal display device may not conform to the external device.

DETAILED DESCRIPTION

Figure 1:
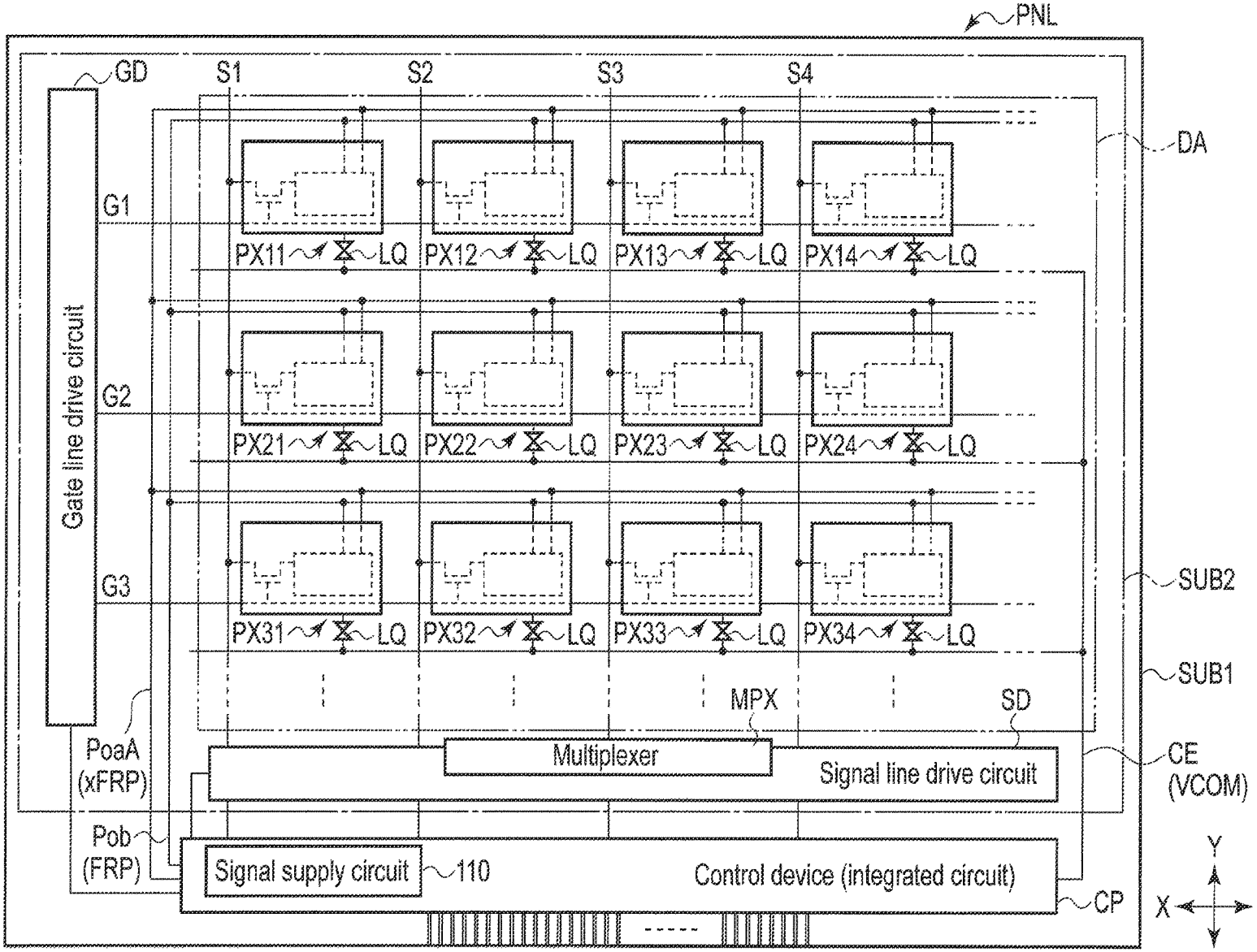
FIG. 1 schematically shows the whole structure of a signal supply circuit and a display device according to an embodiment.

Various embodiments will be described hereinafter with reference to the accompanying drawings.

The embodiments provide a signal supply circuit and a display device capable of converting video data input from an external device in accordance with the type of the video data and the type of a display panel. Thus, the flexibility of the application range is increased.

In general, according to one embodiment, a signal supply circuit used for a display device comprising a plurality of subpixels each comprising a memory comprises a first mode. The first mode receives first video data in a unit of n bits corresponding to the subpixels from outside, generates digital data corresponding to the subpixels in a unit of m bits less than n bits based on the first video data, and supplies the digital data to the subpixels.

An embodiment will further be described with reference to the drawings.

The disclosure is merely an example, and proper changes in keeping with the spirit of the invention, which are easily conceivable by a person of ordinary skill in the art, come within the scope of the invention as a matter of course. In addition, in some cases, in order to make the description clearer, the widths, thicknesses, shapes, etc., of the respective parts are illustrated in the drawings schematically, rather than as an accurate representation of what is implemented. However, such schematic illustration is merely exemplary, and in no way restricts the interpretation of the invention. In addition, in the specification and drawings, structural elements which function in the same or a similar manner to those described in connection with preceding drawings are denoted by like reference numbers, detailed description thereof being omitted unless necessary.

In the following explanation, this specification describes color filters R, G, B and W, subpixels R, G, B and W, video data items R, G and B, color filters R, G, B and W, output lines R, G, B and W, and signals R, G, B and W. Color filters R, G, B and W refer to red, green, blue and white filters. Subpixels R, G, B and W refer to subpixels comprising color filters R, G, B and W. Output lines R, G, B and W refer to the lines to which the video data items to be allocated to subpixels R, G, B and W are output. Video data items R, G and B refer to the video data items to be allocated to subpixels R, G and B.

FIG. 1 schematically shows an example of the structure of a display panel PNL. A display device comprises an active-matrix display panel PNL. The display panel PNL comprises a first substrate SUB1, a second substrate SUB2 facing the first substrate SUB1, and a liquid crystal layer LQ held between the first substrate SUB1 and the second substrate SUB2. The second substrate SUB2 is indicated by an alternate long and short dash line.

A display area DA is equivalent to the area in which the liquid crystal layer LQ is held between the first substrate SUB1 and the second substrate SUB2. For example, the display area DA is rectangular. A plurality of subpixels PX (PX11, PX12, . . . ) are arranged in matrix in the display area DA.

In the display area DA, the first substrate SUB1 comprises a plurality of gate lines G (G1 to Gn) extending in a first direction X, and a plurality of signal lines S (S1 to Sm) extending in a second direction Y and intersecting the gate lines G extending in the first direction X.

The gate lines G (G1 to Gn) are extended to the outside of the display area DA and connected to a gate line drive circuit (a first drive circuit) GD. The signal lines S (S1 to Sm) are extended to the outside of the display area DA and connected to a source line drive circuit (a second drive circuit) SD. For example, the first drive circuit GD and the second drive circuit SD are at least partially formed on the first substrate SUB1, and are connected to a control device (a drive IC chip or a liquid crystal driver) CP.

The second drive circuit SD comprises a multiplexer MPX which receives a pixel signal from the control device CP. The multiplexer MPX supplies the received pixel signal to a corresponding subpixel via a signal line corresponding to the pixel signal. The multiplexer MPX outputs, for example, a plurality of pixel signals for one line, to an appropriate signal line.

To control the first drive circuit GD and the second drive circuit SD, the control device CP comprises a built-in clock and timing pulse generation circuit (a controller or a sequencer), and functions as a signal supply source which supplies a signal necessary to drive the display panel PNL. The control device CP includes a signal supply circuit 110.

The signal supply circuit 110 includes an input adaptive control circuit which switches the operation mode in accordance with the type of video data as described later. With respect to the type of video data, as explained in detail later, a combination of red (R), green (G) and blue (B) video data items, a combination of red (R), green (G), blue (B) and dummy (DUM) video data items, a combination of red (R), green (G), blue (B) and white (W) video data items, and simple 1 bit of video data are considered.

In the example of FIG. 1, the control device CP is mounted on the first substrate SUB1 outside the display area DA of the display panel PNL.

A common electrode CE is formed of a transparent material, and is provided on the second substrate SUB2. The common electrode CE corresponds to the entire display area DA. For example, the common electrode CE is formed for a plurality of subpixels PX. The common electrode CE is extended to the outside of the display area DA and connected to a feed module provided in the control device CP. The feed module outputs a certain common voltage.

Color filters are arranged based on predetermined rules in the pixels PX. The color filters face pixel electrodes so as to interpose the liquid crystal layer LQ between them, and are formed on the second substrate SUB2.

Figure 2A:
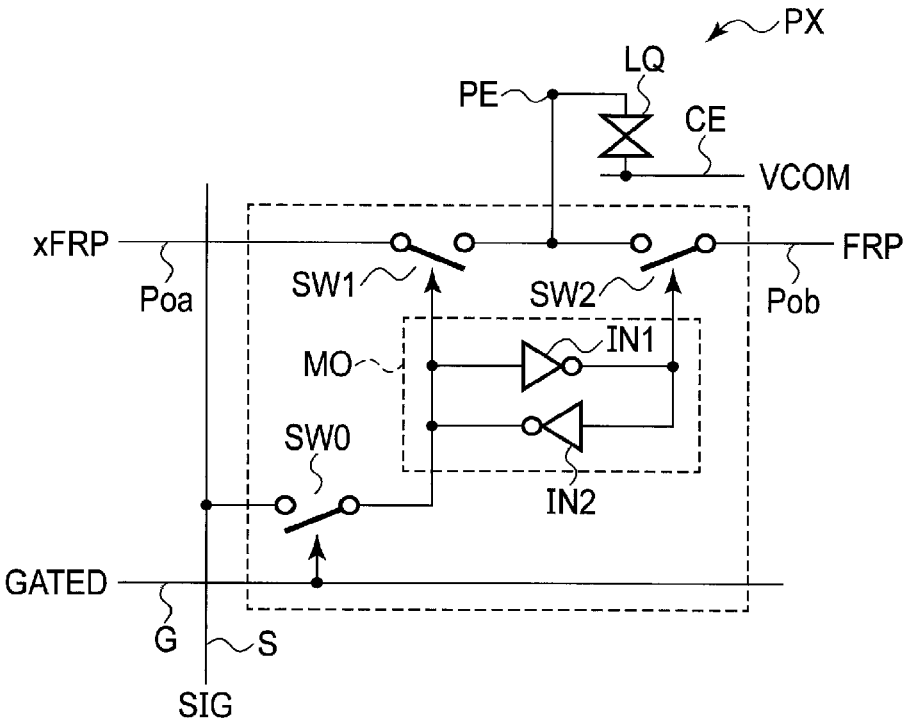
FIG. 2A is a circuit diagram showing the basic structure of a pixel comprising a memory.

FIG. 2A shows the structure of each subpixel (or pixel) PX comprising a memory. In the subpixel PX, an end of switch SW0 is connected to the signal line S. The other end of switch SW0 is connected to memory M0. The control terminal of switch SW0 is connected to the gate line G. Memory M0 comprises, for example, inverters IN1 and IN2. Inverters IN1 and IN2 are in parallel connection, and in reverse connection. The input terminal of inverter IN1 (the output terminal of inverter IN2) is connected to the control terminal of switch SW1. The output terminal of inverter IN1 (the input terminal of inverter IN2) is connected to the control terminal of switch SW2).

The input terminal of switch SW1 is connected to a first signal line Poa. The output terminal of switch SW1 is connected to the pixel electrode PE of the display element formed in the liquid crystal layer. The input terminal of switch SW2 is connected to a second signal line Pob. The output terminal of switch SW2 is connected to the pixel electrode PE. A first signal (display signal) xFRP is supplied to the first signal line Poa. A second signal (non-display signal) FRP is input to the second signal line Pob. The first and second signals xFRP and FRP are AC signals having opposite phases, and are generated by the control device CP shown in FIG. 1. A common signal VCOM is supplied from the control device CP to the common electrode CE facing the pixel electrode PE. The common signal VCOM is an AC signal having the same phase as, for example, the second signal FRP.

Figure 2B:
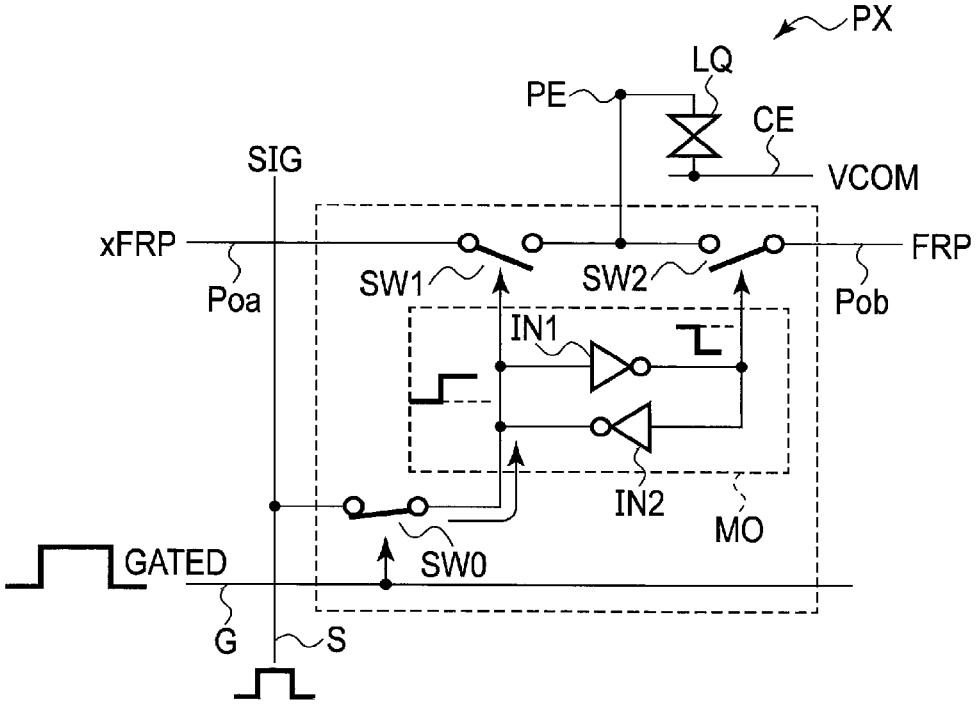
FIG. 2B shows an example of operation performed when data is written to the memory of a pixel.

FIG. 2B shows an example of operation performed when a value of 1 is written to memory M0 of the above subpixel PX. When a gate pulse GATED is supplied to the gate line G, switch SW0 is turned on. When a signal SIG (a value of 1) is output to the signal line S, a value of 1 (a high level) is written to and held by memory M0. At this time, inverter IN1 inverts the input. Thus, the output of inverter IN1 is 0 (low). Since the input of inverter IN2 is low, the output of inverter IN2 is high. When switch SW0 is turned off, memory M0 holds a value of 1.

Figure 3:
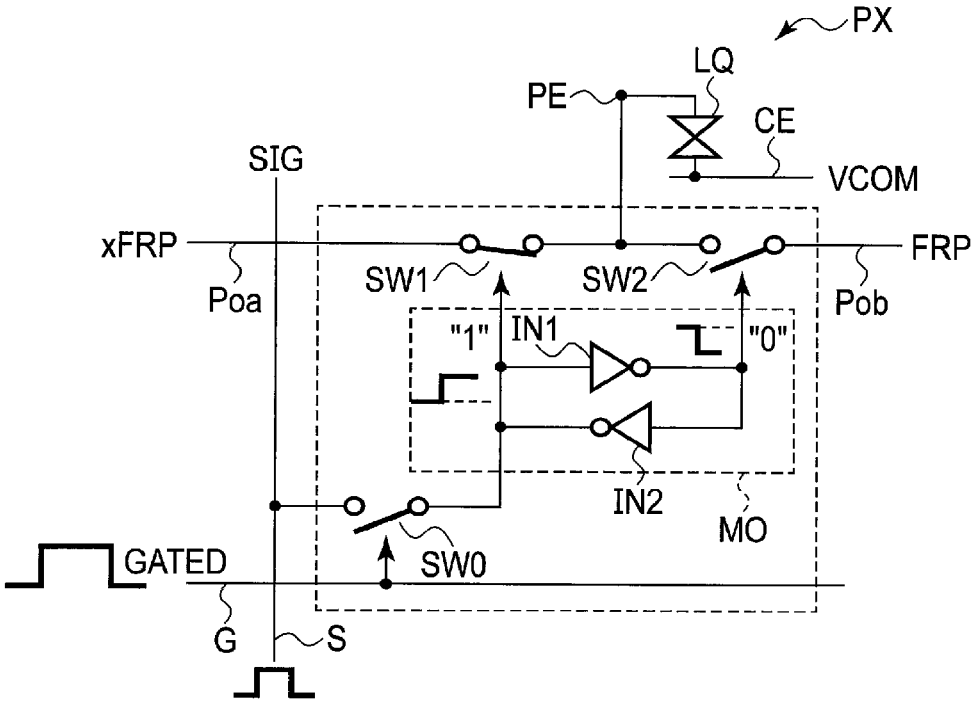
FIG. 3 shows an example of the state of a period (display period) in which data is held in a pixel comprising a memory.

As shown in FIG. 3, switch SW0 is turned off. A value of 1 is held by memory M0. By the output of memory M0, switch SW1 is turned on, and switch SW2 is turned off. As a result, the first signal xFRP is supplied to the pixel electrode PE of the display element (liquid crystal layer) LQ. A common signal VCOM is supplied to the common electrode CE.

Figure 4:
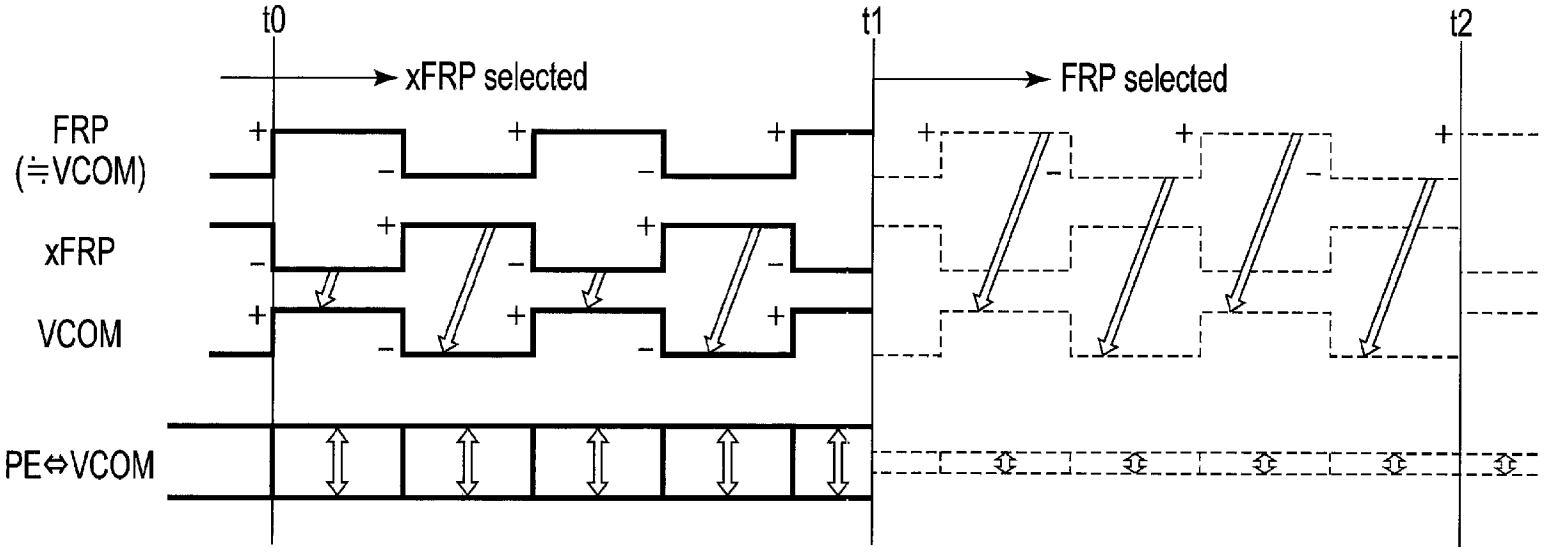
FIG. 4 shows an example of a waveform and hold data to explain an example of operation performed in a period (display period) in which data is held by a pixel comprising a memory.

FIG. 4 shows a change in the difference in potential between the pixel electrode PE and the common electrode CE in the above subpixel PX. FIG. 4 shows that the first signal xFPR and a common signal VCOM are supplied to the pixel electrode PE and the common electrode CE, respectively, in times t0 to t1. The first signal xFRP and a common signal VCOM have opposite phases. Thus, the difference in potential between the pixel electrode PE and the common electrode CE is large. At this time, the display element forms a display state in the case of normally black.

When a value of 0 is held by memory M0, switch SW1 is turned off, and switch SW2 is turned on. In this manner, as shown in times t1 to t2 of FIG. 4, the second signal FRP and a common signal VCOM are supplied to the pixel electrode PE and the common electrode CE, respectively. Since the second signal FRP and a common signal VCOM have the same phase, the difference in potential between the pixel electrode PE and the common electrode CE is small. At this time, the display element forms a non-display state.

Figure 5:
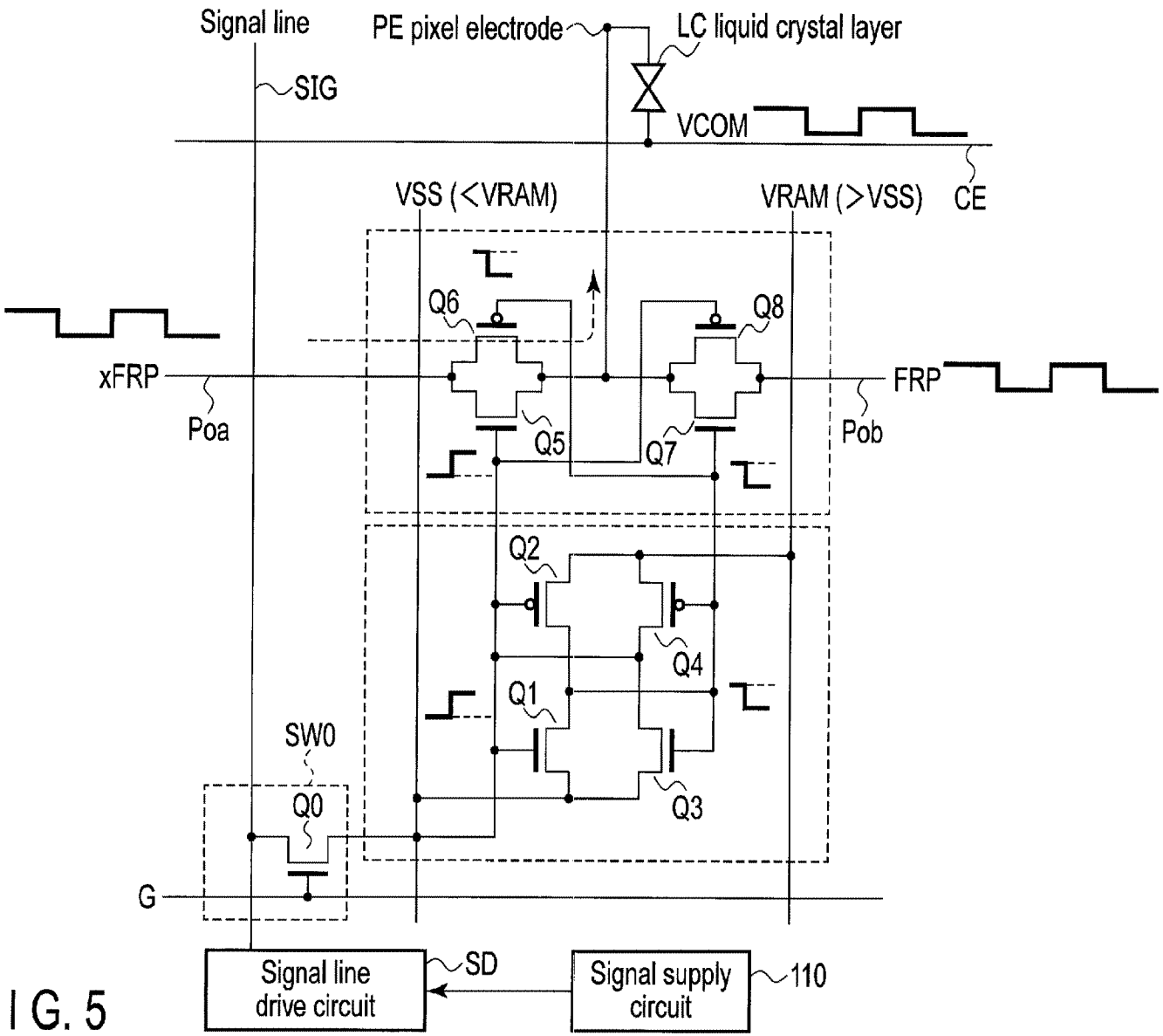
FIG. 5 is a circuit diagram showing the further details of the circuit structure of FIG. 2A.

FIG. 5 shows the further details of the circuit structure of the subpixel shown in FIG. 2A, FIG. 2B and FIG. 3. Switch SW0 comprises, for example, thin-film transistor Q0. Memory M0 comprises thin-film transistors Q1, Q2, Q3 and Q4. Switch SW1 comprises thin-film transistors Q5 and Q6. Switch SW2 comprises thin-film transistors Q7 and Q8. When a value of 1 is written to memory M0, thin-film transistors Q1 and Q4 are turned on, and thin-film transistors Q2 and Q3 are turned off. At this time, by the output of memory M0, thin-film transistors Q5 and Q6 are turned on, and thin-film transistors Q7 and Q8 are turned off. When a value of 0 is written to memory M0, thin-film transistors Q2 and Q3 are turned off, and thin-film transistors Q1 and Q4 are turned off. By the output of memory M0, thin-film transistors Q5 and Q6 are turned off, and thin-film transistors Q7 and Q8 are turned on.

Figure 6:
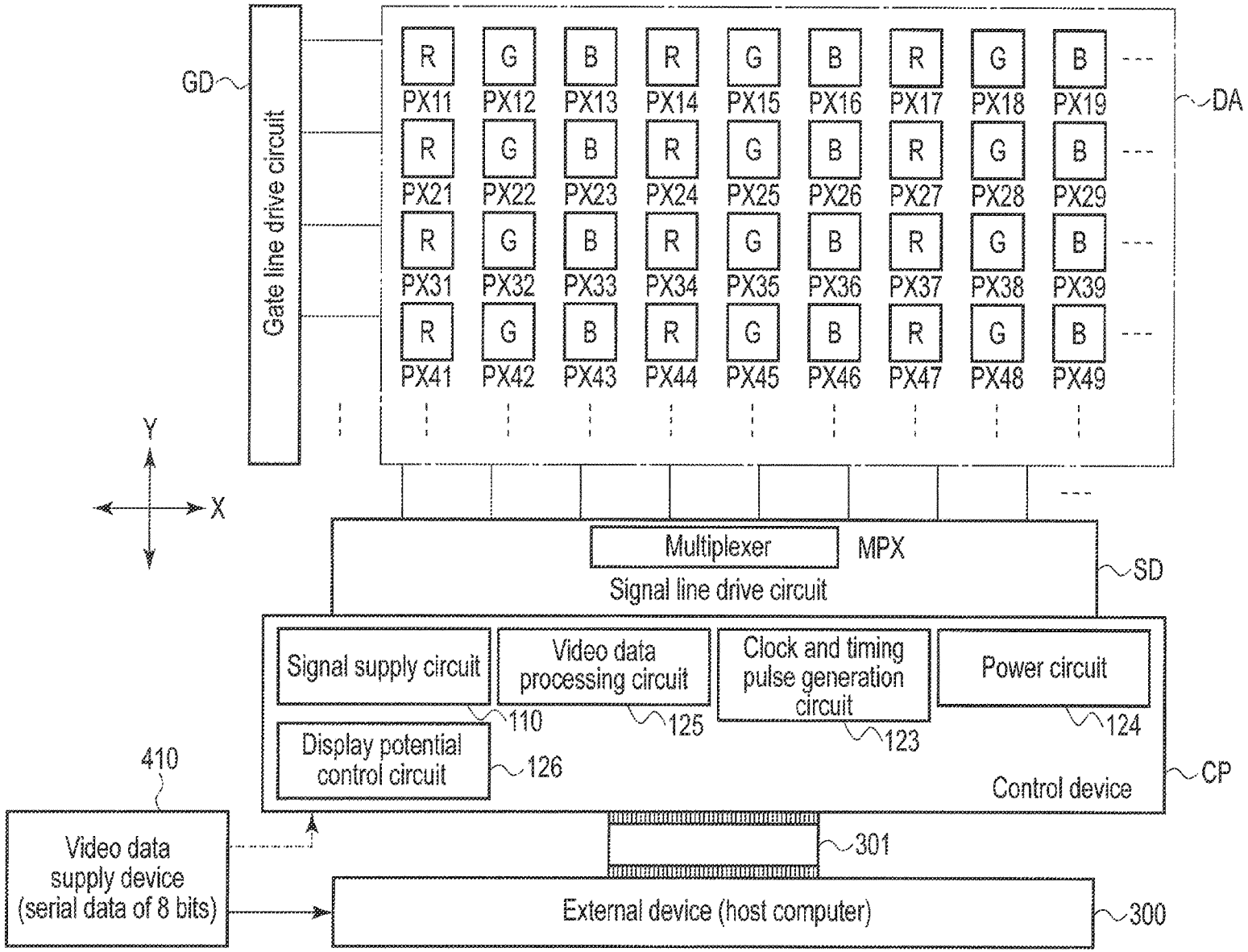
FIG. 6 shows an example of a display panel applied to the embodiment.

FIG. 6 particularly shows the structural elements of the control device CP in the signal supply circuit and the display device according to one embodiment. FIG. 6 also shows a layout example of color filters corresponding to the subpixels PX in the display area DA of the display panel PNL. Color filters R, G, B, R, G, B, . . . are repeatedly arranged in the X-direction. The filters of the same color are continuously arranged in the Y-direction. In this layout example, color filters R are arranged in the first column. Color filters G are arranged in the second column. Color filters B are arranged in the third column. The layout of the color filters is not limited to that of the example of FIG. 6. As a matter of course, various examples are considered for the layout.

The control device CP comprises a power circuit 124, a clock and timing pulse generation circuit 123, a video data processing circuit 125, a display potential control circuit 126, etc., in addition to the signal supply circuit 110. The power circuit 124 generates various voltages, using the power source voltage received from an external battery. The clock and timing pulse generation circuit 123 generates various clocks and various timing signals used in the control device CP, the gate line drive circuit GD, the signal line drive circuit SD, etc.

The control device CP receives a video signal, a synchronous signal, control data, etc., from an external device (which may be referred to as a host computer) 300 via a connection line formed on a flexible board 301. Video data and a synchronous signal are input to the video data processing circuit 125, and are converted into the video data to be supplied to the display panel PNL. Control data is loaded into the clock and timing pulse generation circuit 123, and is used to control the operation of the display device. The display potential control circuit 126 provided in the control device CP basically generates the first signal xFRP and the second signal FRP explained in FIG. 2A, FIG. 2B and FIG. 3, etc. When the display potential control circuit 126 obtains a special display state such as black-and-white inversion lighting or negative-and-positive inversion lighting, the display potential control circuit 126 may apply the first signal xFRP or the second signal FRP explained in FIG. 2A, FIG. 2B and FIG. 3 to the pixel electrode such that the state of the signal is changed. For example, the display potential control circuit 126 is capable of performing control such that the first signal xFRP and the second signal FRP are temporarily or intermittently maintained at a certain level in a selective manner.

Serial data is supplied from a video data supply device 410 to the external device 300 or the control device CP. The method for supplying serial data from the video data supply device 410 to the external device 300 or the control device CP may use either a wireless transmit-receive system or a wired transmit-receive system. The video data supply device 410 may transmit data via the Internet.

The signal supply circuit 110 of the display device is capable of flexibly processing the serial data supplied from the video data supply device 410. The serial data may include various commands (control data) and address data in addition to video data of 8 bits. The serial data may be directly input to the signal supply circuit 110, or may be input to the external device 300. The type of video data included in the serial data varies depending on the specification or the manufacturer. However, as described later, the signal supply circuit 110 is capable of flexibly processing the serial data supplied from the video data supply device 410.

Figure 7:
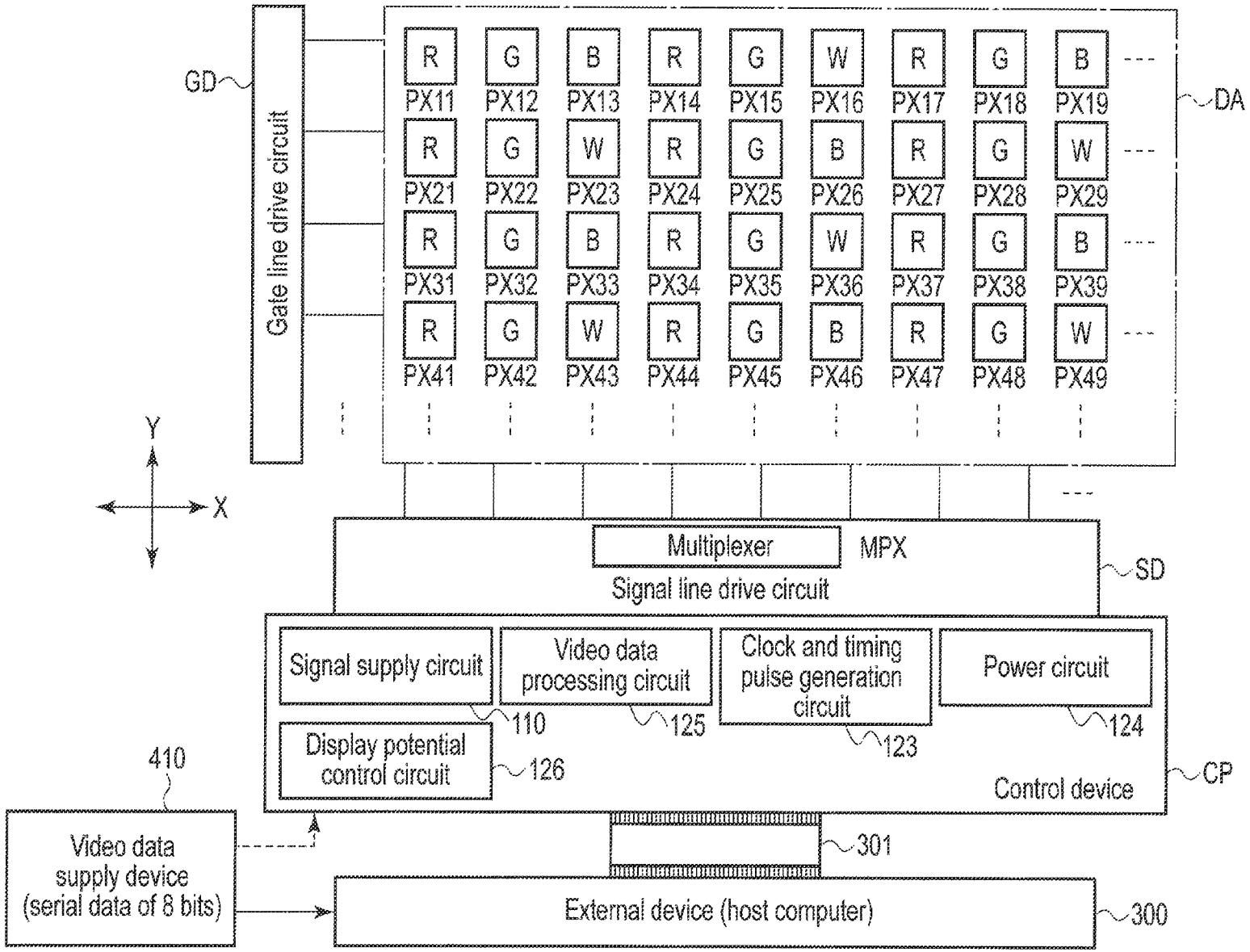
FIG. 7 shows an example of another display panel applied to the embodiment.

FIG. 7 shows an example of the display device in which the color filters of the display panel PNL are arranged in a manner different from that of the example shown in FIG. 6. The same portions as FIG. 6 are denoted by the same reference numbers, and their detailed explanation is omitted. In the layout example of the color filters of FIG. 7, color filters R are arranged in the first column, and color filters G are arranged in the second column. Color filters B and W are alternately arranged in the third column. Color filters R are arranged in the fourth column. Color filters G are arranged in the fifth column. Color filters W and B are alternately arranged in the sixth column. This layout of the color filters is repeated in the X-direction. When the third, sixth and ninth columns are viewed in the row direction (X-direction), color filters W and B are repeatedly arranged in the order of, for example, W, B, W, B. Various patterns are available for the layout of four color filters (subpixels) W, B, W and B. Any pattern may be applied to the present embodiment.

Figure 8:
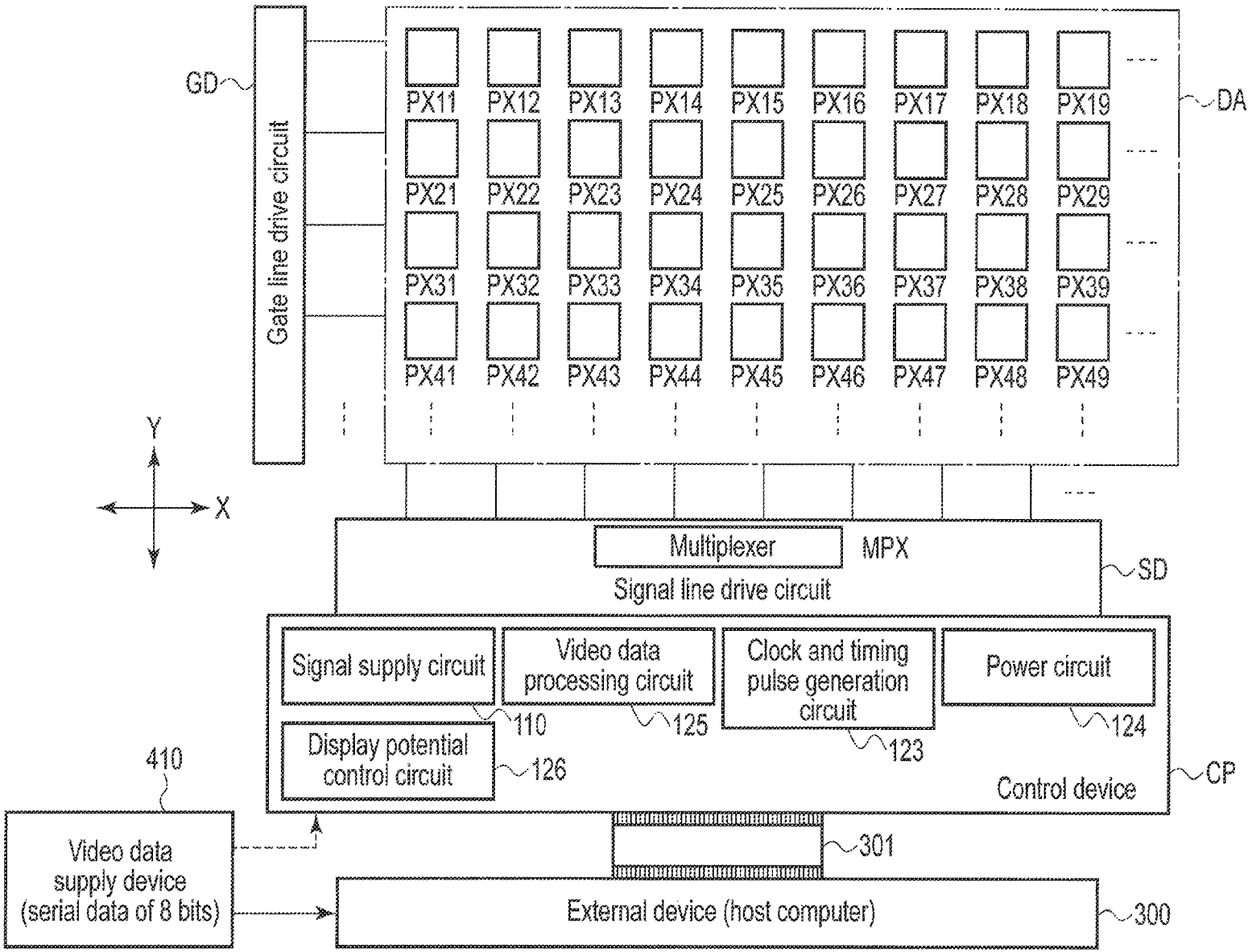
FIG. 8 shows an example of yet another display panel applied to the embodiment.

FIG. 8 shows an example of another display panel PNL. The display panel PNL is a display panel for monochrome display. The display panel PNL does not comprise any color filter. The aperture region of each pixel is transparent. Notes, the display panel PNL may comprise, for example, a correction color filter for adjusting the retardation or wavelength of light emitted from a light source.

In general, in many cases, data processed in digital devices is dealt with in multiple bits (for example, 8 bits, 16 bits or 32 bits). If these bits are said in another way, one unit will be the number of bits of an 8-bit multiple. The video data supply device 410 is a device which outputs serial data based on 8 bits unit.

FIG. 9 to FIG. 14 show various examples of transmission forms of serial data supplied from the video data supply device 410. Transmission lines are used to transmit video data, control data, address data, etc., based on specific rules. Various types of video data are explained below.

SCS refers to a period specification signal (which may be referred to as a synchronous signal or an enable period signal) for specifying the period in which a certain amount of serial data is transmitted. SCS rises when the system detects, for example, a framing signal (a synchronous leading signal; omitted in the figure) included in serial data SI.

SI refers to serial data, and includes the above framing signal, mode control data (M0, M1, . . . , M5), gate line address specification data (AG9, AG8, AG7, . . . , AG0), video data, dummy data, etc. SI may further include a synchronous clock indicating a data boundary, an error correction code, etc.

SCLK refers to a serial clock (or a system clock). SCLK is synchronized with serial data, and is capable of sampling serial data. A serial data processor which receives serial data determines serial data of 8 bits, and separates it into video data, control data, address specification data, etc. The video data is transmitted to a data conversion module (which may be referred to as a data controller) as described later. The control data, the address specification data, etc., are adjusted in the control device CP in terms of the output timing, and are transmitted to the signal supply circuit 110, the gate line drive circuit GD, etc.

Figure 9:
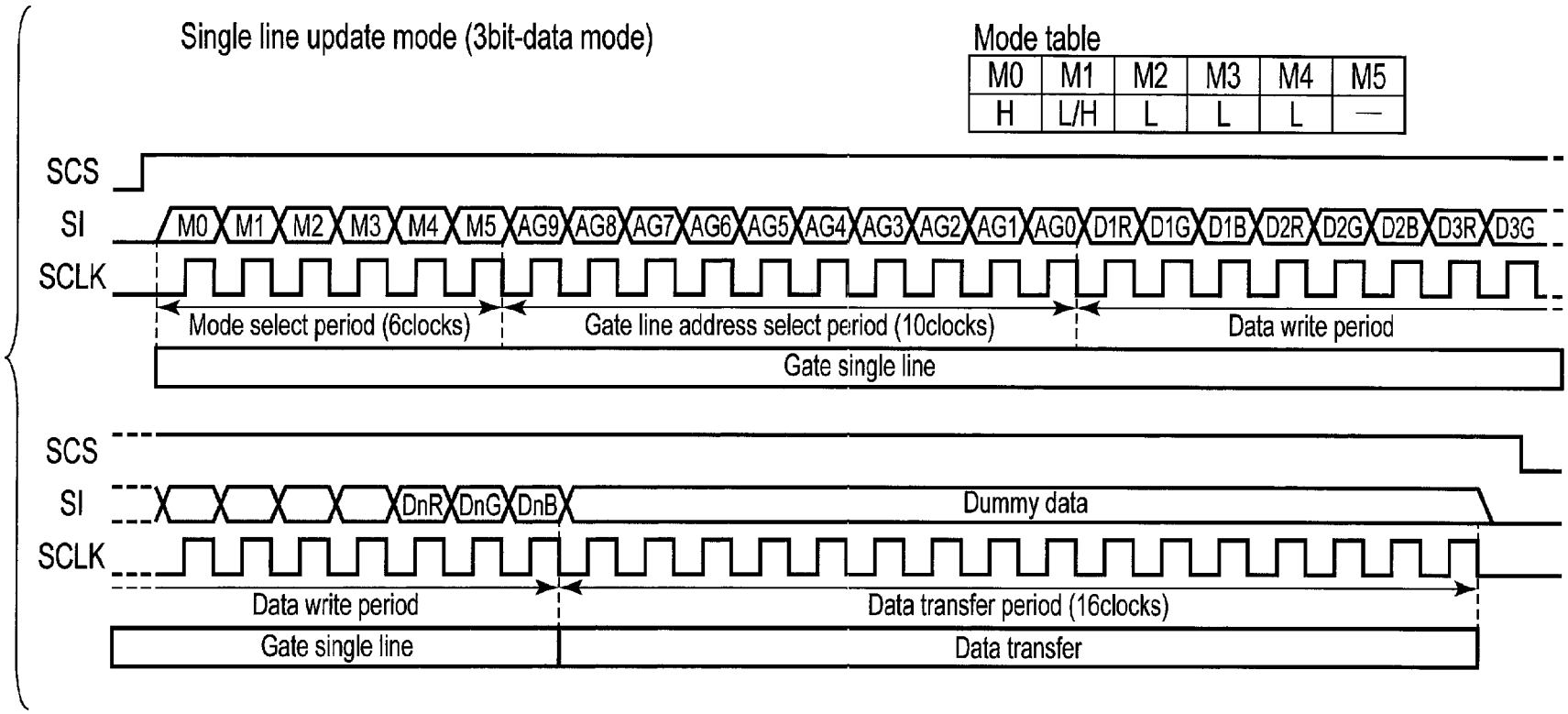
FIG. 9 shows an example of serial data output from a video data supply device.

In the example of FIG. 9, the serial data transmitted from the video data supply device 410 includes video data items R, G and B. The mode of this type of video data is called a 3 bit-data mode, and the data may be called data in a unit of 3 bits.

In the serial data, data items M0 to M5 of 6 clocks constitute a mode table. In this transmission form, the mode table shows M0=H (high), M1=L (low)/H (high), M2, M3 and M4=L (low), and M5=–(indefinite). This information indicates that the serial data includes video data items R, G and B.

In this transmission form, video data for a single line (which may be called one line) is transmitted in the single period specified by SCS. This transmission form is called a single lines update mode. In this transmission form, video data items R, G and B for one line (one line in the X-direction) are transmitted in the single period specified by SCS. This transmission form is recognized by, for example, the signal supply circuit and/or the control device. The signal supply circuit and/or the control device recognize(s) the transmission form by determining the continuous period of dummy data in the data transfer period (for example, when the period of 7 clocks is exceeded). The signal supply circuit and/or the control device recognize(s) that the information of one line has been updated in the single period specified by SCS.

As shown in FIG. 9, when SCS rises (in other words, when SCS is set to a logic 1), the array of M0 to M5 comes in synchronization with system clocks. The data array period from M0 to M5 is called a mode select period. Gate line address specification data (AG9, AG8, AG7, . . . , AG0) follows. This data array period is called a gate line address select period. By the gate line address specification data, the write line of the subsequent video data is determined. Subsequently, the repeating array of video data items R, G and B comes. In FIG. 9, this array is shown as data items D1R, D1G, D1B, D2R, D2G, D2B, D3R, D3G, D3B, . . . , DnR, DnG, DnB. This period is called a data write period. The subsequent period is called a data transfer period. The data transfer period ensures a time to finish extracting the above data in the data processor and writing the video data to the display panel.

Figure 10:
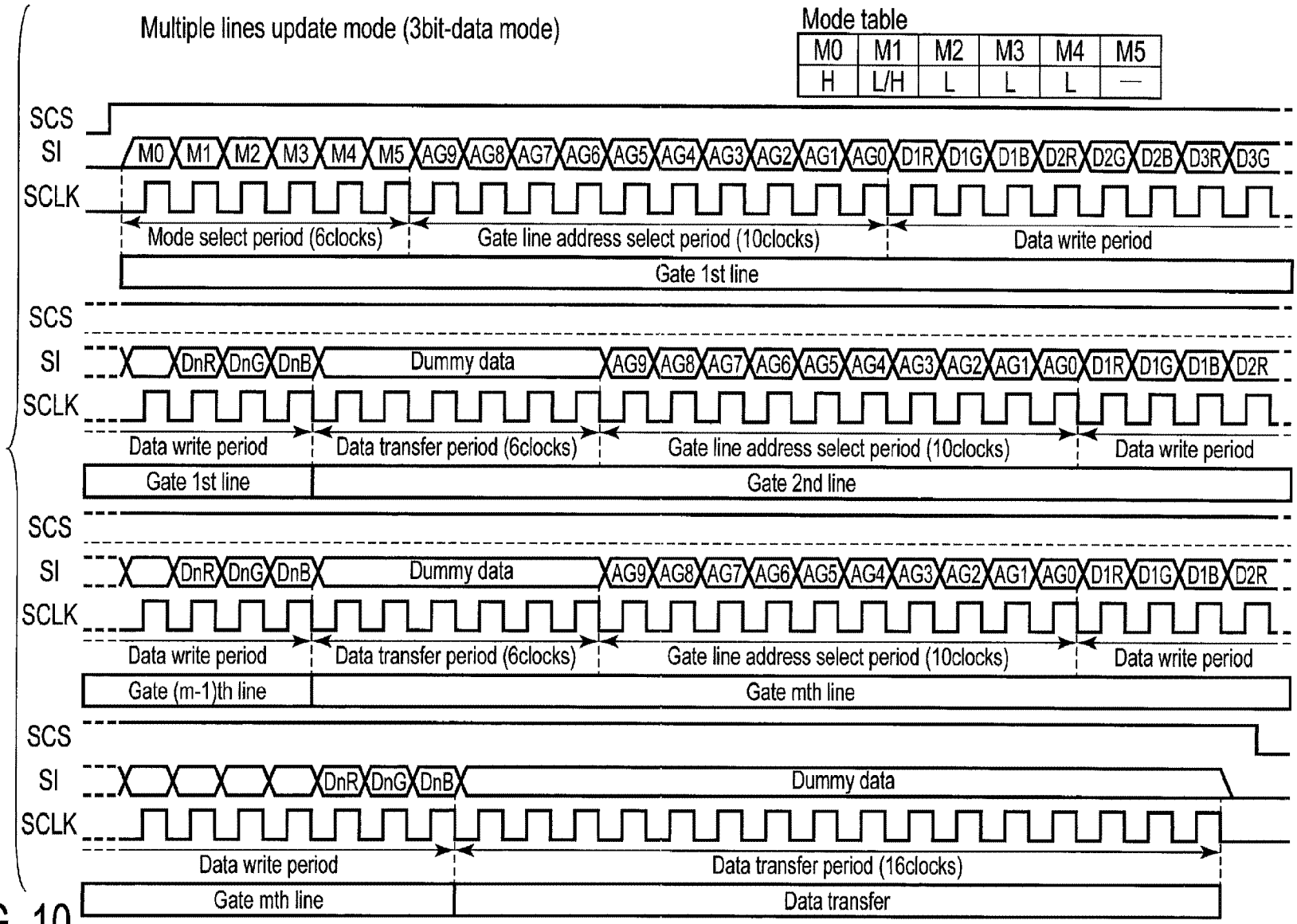
FIG. 10 shows another example of serial data output from the video data supply device.

FIG. 10 shows an example in which the serial data transmitted from the video data supply device 410 includes video data items R, G and B. The mode of this type of video data is called a 3 bit-data mode. In this case, the mode table related to video shows M0=H, M1=L/H, M2, M3 and M4=L, and M5=–(indefinite).

In this transmission form, video data items R, G and B for a plurality of lines (a plurality of lines in the Y-direction) are transmitted in the single period specified by SCS. A plurality of lines are updated in the single period specified by SCS. This transmission form is called a multiple lines update mode. In this transmission form, a combination of a gate line address select period and a data write period is repeated a plurality of times. In FIG. 10, the gate line specified by the data of the first gate line address select period is indicated as "gate 1st line". The gate line specified by the data of the second gate line address select period is indicated as "gate 2nd line". The gate line specified by the data of the mth gate line address select period is indicated as "gate mth line". The other systems are the same as those of the example shown in FIG. 9.

Figure 11:
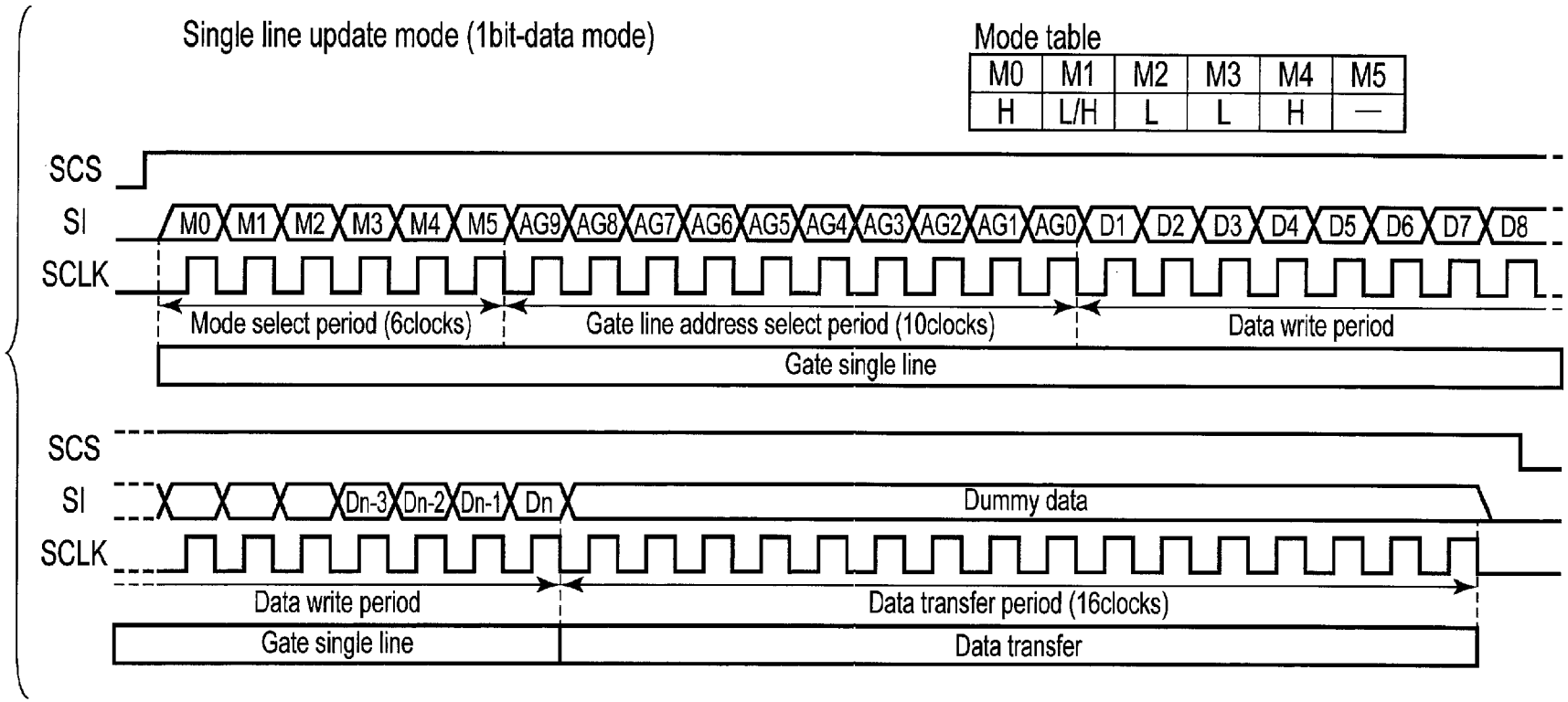
FIG. 11 shows yet another example of serial data output from the video data supply device.

FIG. 11 shows an example in which the video data included in the serial data transmitted from the video data supply device 410 is monochrome. The mode of this type of video data is called a 1 bit-data mode. In this case, the mode table related to video shows M0=H, M1=L/H, M2 and M3=L, M4=H and M5=–(indefinite).

Video data for a single line (one line) is transmitted in the single period specified by SCS. This transmission form is called a single line update mode. The other items of the system are the same as those of the examples shown in FIG. 9, FIG. 10, etc.

Figure 12:
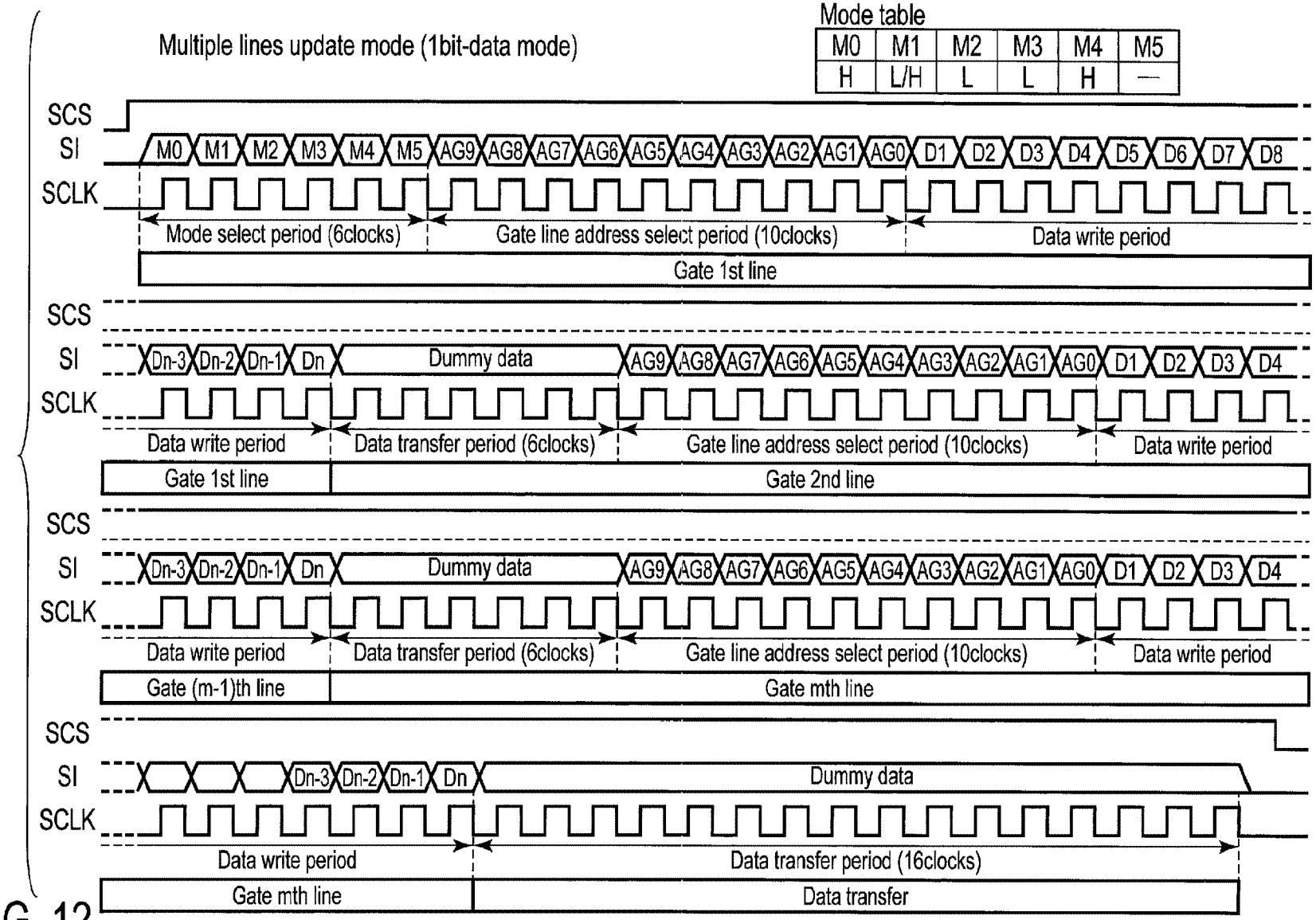
FIG. 12 shows another example of serial data output from the video data supply device.

FIG. 12 shows an example in which the video data included in the serial data transmitted from the video data supply device 410 is monochrome. The mode of this type of video data is called a 1 bit-data mode, and the data may be called data in a unit of 1 bit. The mode table related to video shows M0=H, M1=L/H, M2 and M3=L, M4=H and M5=–(indefinite).

Video data for a plurality of lines (multiple lines) is transmitted in the single period specified by SCS. This transmission form is called a multiple lines update mode. The other items of the system are the same as those of the examples shown in FIG. 9, FIG. 10, FIG. 11, etc.

Figure 13:
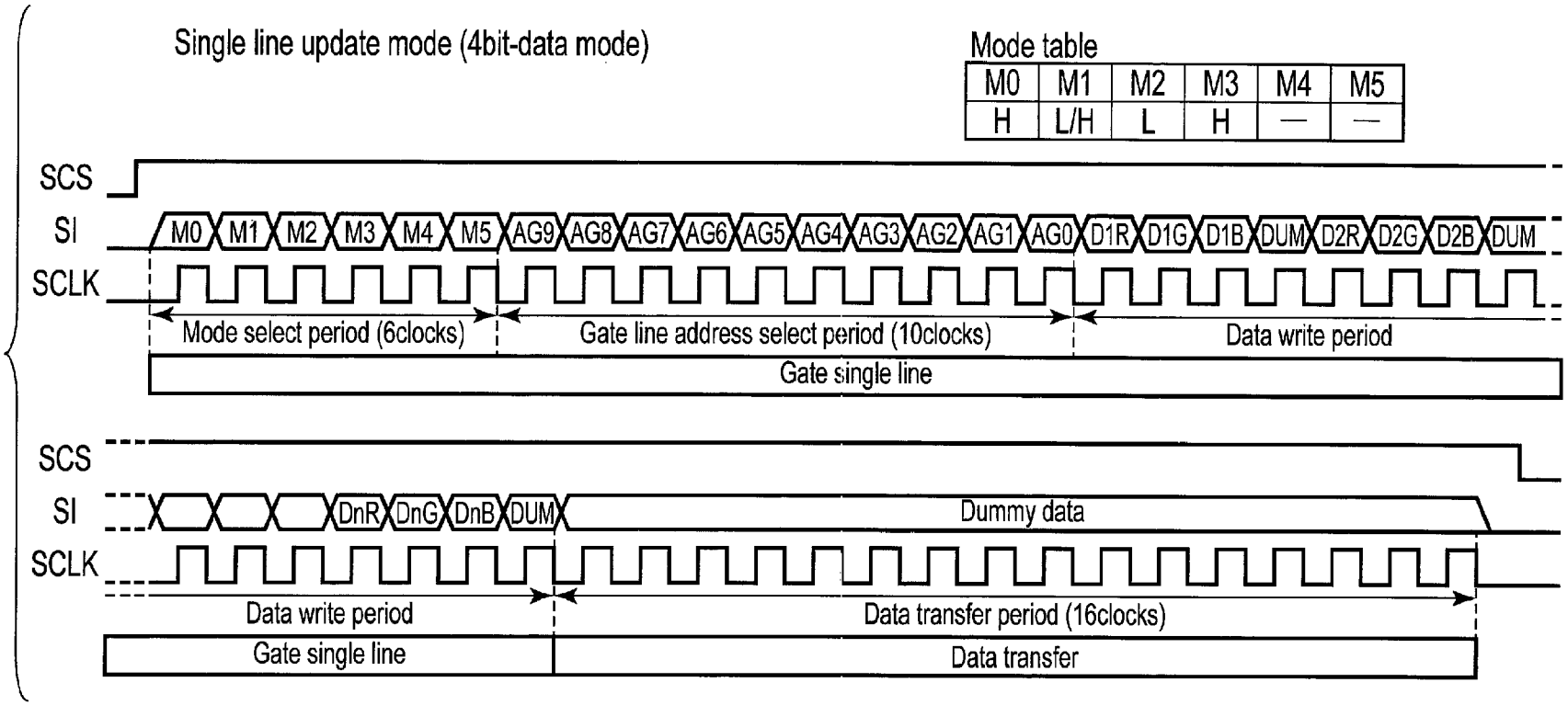
FIG. 13 shows another example of serial data output from the video data supply device.

FIG. 13 shows an example in which the serial data transmitted from the video data supply device 410 includes video data items R, G and B and a dummy data item DUM. The mode of this type of video data is called a 4 bit-data mode. The mode table related to video shows M0=H, M1=L/H, M2=L and M3=H, M4=–(indefinite) and M5=–(indefinite). In this transmission form, video data for a single line (one line) is transmitted in the single period specified by SCS. This transmission form is called a single line update mode. The other items of the system are the same as those of the examples shown in FIG. 9, FIG. 10, etc.

Figure 14:
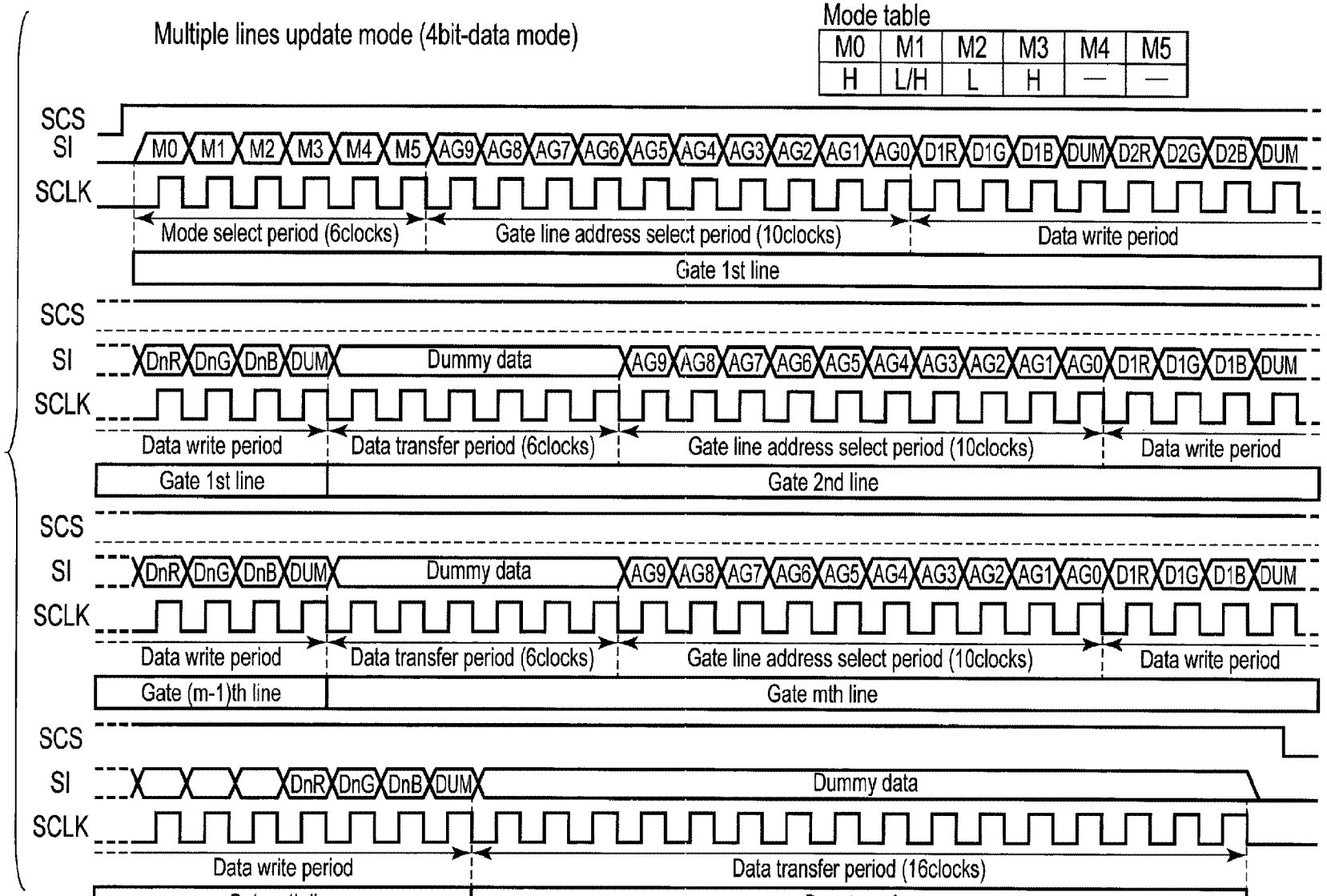
FIG. 14 shows another example of serial data output from the video data supply device.

FIG. 14 shows an example in which the serial data transmitted from the video data supply device 410 includes video data items R, G and B and a dummy data item DUM. The mode of this type of video data is called a 4 bit-data mode, and the data may be called data in a unit of 4 bits. The mode table related to video shows M0=H, M1=L/H, M2=L and M3=H, M4=–(indefinite) and M5=–(indefinite). In this transmission form, video data for a plurality of lines (multiple lines) is transmitted in the single period specified by SCS. This transmission form is called a multiple lines update mode. The other items of the system are the same as those of the examples shown in FIG. 9, FIG. 10, FIG. 11, FIG. 12, FIG. 13, etc.

Figure 15:
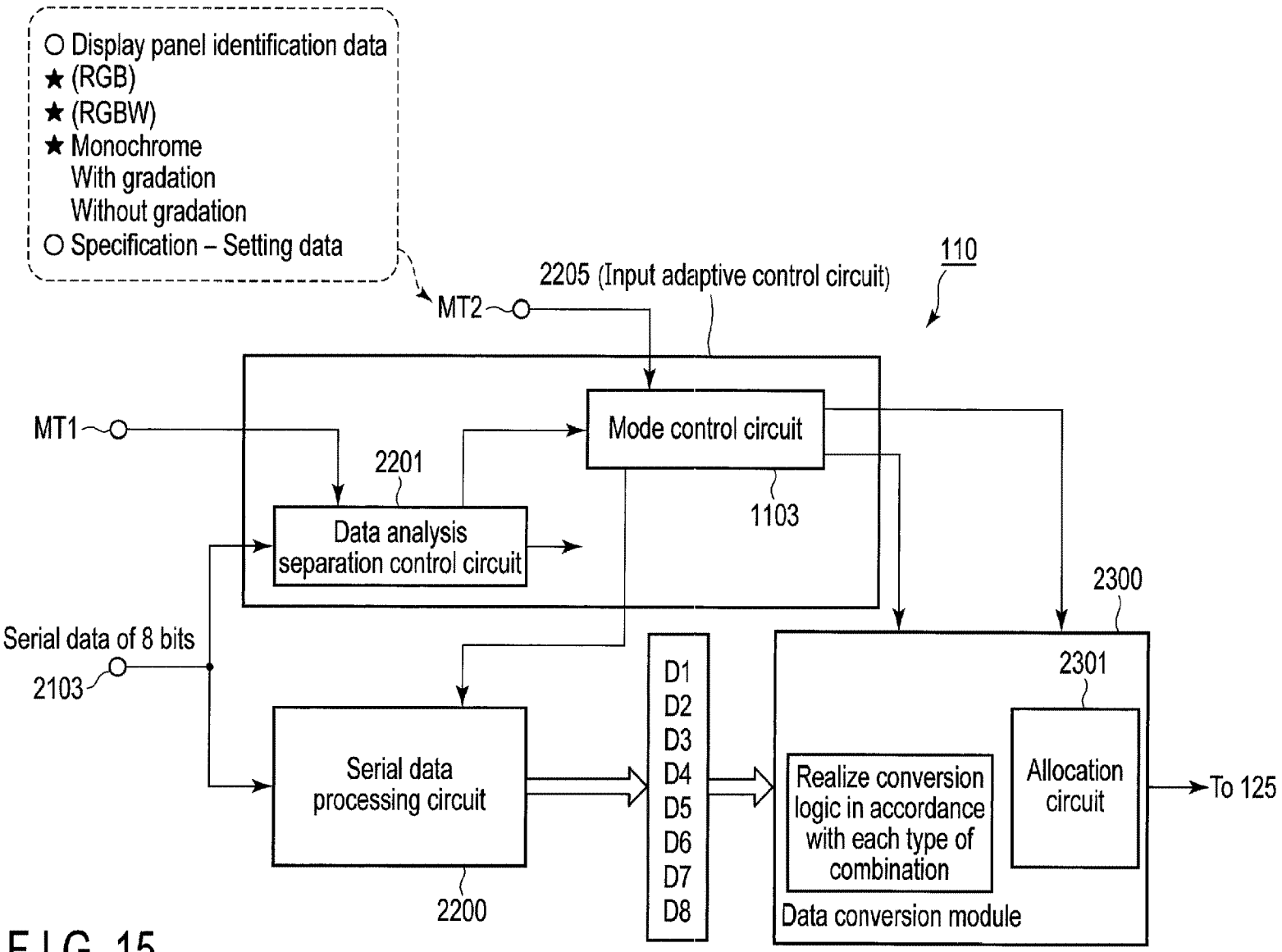
FIG. 15 shows an example of the internal structure of the signal supply circuit according to the embodiment.

FIG. 15 shows an embodiment of the signal supply circuit 110 which receives and processes the above serial data. Serial data is input to an input terminal 2103. The input terminal 2103 is connected to a data analysis separation control circuit 2201 and a serial data processing circuit 2200. The data analysis separation control circuit 2201 is able to determine that the mode of the input serial data is which of the modes explained in FIG. 9 to FIG. 14. The data analysis separation control circuit 2201 operates in synchronization with SCS and SCLK, and generates a sectional signal in accordance with the rules determined by the specification in advance. The sectional signal allows the serial data to be separated into mode control data (M0, M1, . . . , M5), gate line address specification data (AG9, AG8, AG7, . . . , AG0), video data, dummy data and the other data.

The data analysis separation control circuit 2201 receives one of the serial data such as shown from FIG. 9 to FIG. 14, and is able to determine that the mode table as one of 4 bit-data mode, 3 bit-data mode and 1 bit-data mode as the types of video data, and also the serial data is not the update modes or the update modes. The data analysis separation control circuit 2201 is capable of separating, from the serial data, the gate line address data specifying the address of the gate line to which video data should be written. This address data is supplied to the clock and timing pulse generation circuit 123 which controls the gate line drive circuit GD, etc. The clock and timing pulse generation circuit 123 controls the gate line drive circuit GD based on the gate line address data. In this way, video data is written to the memories of an appropriate line.

When the type of serial video data or the update mode included in the serial data input to the input terminal 2103 is specified in advance, the data analysis separation control circuit 2201 is capable of receiving information identifying the mode indicating the type and update mode from operation mode setting terminal MT1. This mode identification information may be input by the user, or may be input by the manufacturer when shipping the display device. When the mode identification information is not set, the type of serial video data and the update mode are automatically identified, using the input serial data.

The data analysis separation control circuit 2201 supplies information indicating the type of video data and the update mode to a mode control circuit 1103. The mode control circuit 1103 is capable of receiving the information of the specification of the display panel (in other words, the information of the type of the display panel PNL) from operation mode setting terminal MT2. The type identification information may be input by the user, or may be input by the manufacturer when shipping the display device. When the type identification information is not set, the type of serial video data and the update mode may be automatically identified, using the input serial data. For example, the type of the display panel PNL may be one of the types shown in FIG. 6, FIG. 7 and FIG. 8. The mode control circuit 1103 is capable of generating a timing signal for extracting video data from serial data based on the information indicating the type of video data and the update mode.

In the serial data processing circuit 2200, the video data items input in series as shown in FIG. 9 to FIG. 14 are converted into parallel data items D1 to D8 and output. Parallel data items D1 to D8 are input to a data conversion module 2300 and latched. The data conversion module 2300 includes an allocation circuit 2301. The allocation circuit 2301 allocates each of the data items latched in the data conversion module 2300 to an appropriate color subpixel, and outputs the data items to the subsequent latch circuits which hold data of a horizontal line.

The mode control circuit 1103 may be integrally formed with the data analysis separation control circuit 2201. The integrated block may be referred to as an input adaptive control circuit 2205.

Figure 16:
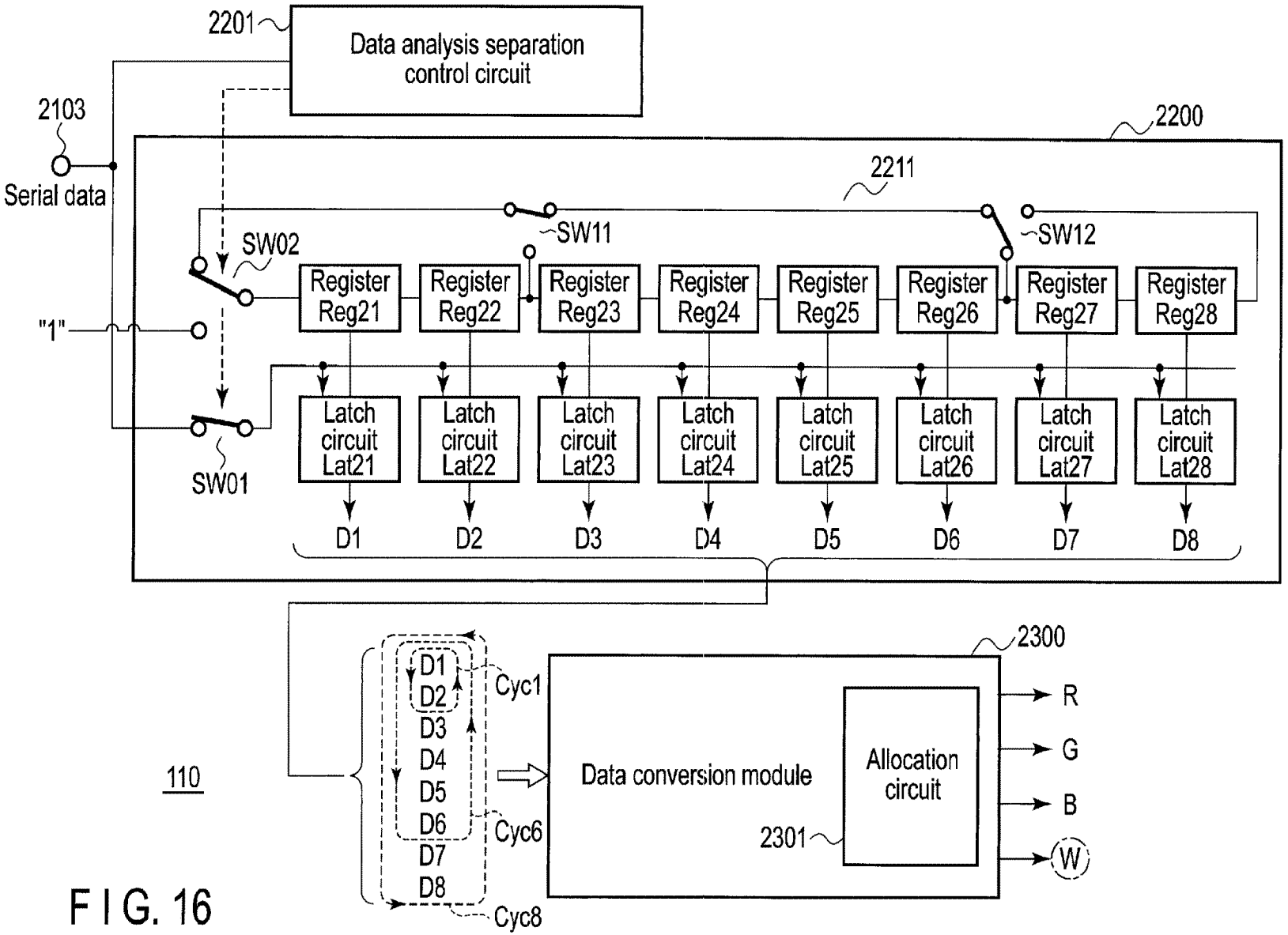
FIG. 16 shows an example of the structure of a serial data processing circuit inside the signal supply circuit according to the embodiment.

FIG. 16 shows an example of a serial parallel conversion circuit inside the serial data processing circuit 2200 shown in FIG. 15. To process the input data of 8 bits, the serial data processing circuit 2200 includes, for example, eight registers Reg21 to Reg28 connected in series, sequentially outputs eight latch pulses (sampling pulses) and cyclically generates eight latch pulses. Thus, the serial data processing circuit 2200 comprises a feedback loop 2211 which feeds back the output of the last register Reg28 to the first register Reg21. Switches SW11 and SW12 are provided in the middle of the feedback loop 2211 such that the operation mode (specifically, the latch timing, the data sampling timing or sampling speed) can be switched in accordance with the mode (shown in FIG. 9 to FIG. 14) of the input video data.

Switch SW12 is capable of feeding back the output of register Reg26 or the output of register Reg28. Switch SW11 is capable of feeding back the output of register Reg22, the output of register Reg26 or the output of register Reg28.

The serial data processing circuit 2200 includes eight latch circuits Lat21 to Lat28 to sequentially latch eight consecutive serial data items (video data items). The eight latch circuits Lat21 to Lat28 are capable of sequentially latching video data items from the input terminal 2103 based on the latch pulses from the eight registers Reg21 to Reg28. Data items D1 to D8 obtained from latch circuits Lat21 to Lat28 are input to the data conversion module 2300.

The input terminal 2103 is connected to the data input terminals of latch circuits Lat21 to Lat28 via switch SW01. Switch SW01 is turned on when the video data items (D1R, DIG, D1B, . . . , DnB) shown in FIG. 9 to FIG. 14 are input to the input terminal 2103. Switch SW02 is used to input an initial value of 1 to register Reg21 and circulate a feedback value of 1 from a subsequent register. Registers Reg21 to Reg28 are driven by a clock having the same phase as the serial clock SCLK. The clock is omitted in FIG. 16.

In the state of FIG. 16, switch SW12 is controlled so as to feed back the output data of register Reg26. In this connection state, a latch operation is performed in latch circuits Lat21 to Lat26. Neither latch circuit Lat27 nor latch circuit Lat28 is used. Thus, six data items D1 to D6 are cyclically output as latch data items since six is a multiple of 3. This operation is effective when the mode of the input video data is a 3 bit-data mode.

When switch SW12 is controlled so as to feed back the output data of register Reg28, a latch operation is performed in latch circuits Lat21 to Lat28. Thus, eight data items D1 to D8 are cyclically output as latch data items since eight is a multiple of four. This operation is effective when the mode of the input video data is a 4 bit-data mode.

When switch SW11 is controlled so as to feed back the output data of register Reg22, a latch operation is performed in latch circuits Lat21 and Lat22. Thus, two data items D1 and D2 are cyclically output as latch data items since two is a multiple of one. This operation is effective when the mode of the input video data is a 1 bit-data mode.

The latch data items obtained in the above manner as parallel data items are input to the data conversion module 2300, and are allocated to an appropriate signal line S (S1 to Sm).

Cycl indicates the cycle of output of data items D1 and D2 when the mode of the input video data is a 1 bit-data mode. Cyc6 indicates the cycle of output of data items D1 to D6 when the mode of the input video data is a 3 bit-data mode. Cyc8 indicates the cycle of output of data items D1 to D8 when the mode of the input video data is a 4 bit-data mode.

Figure 17:
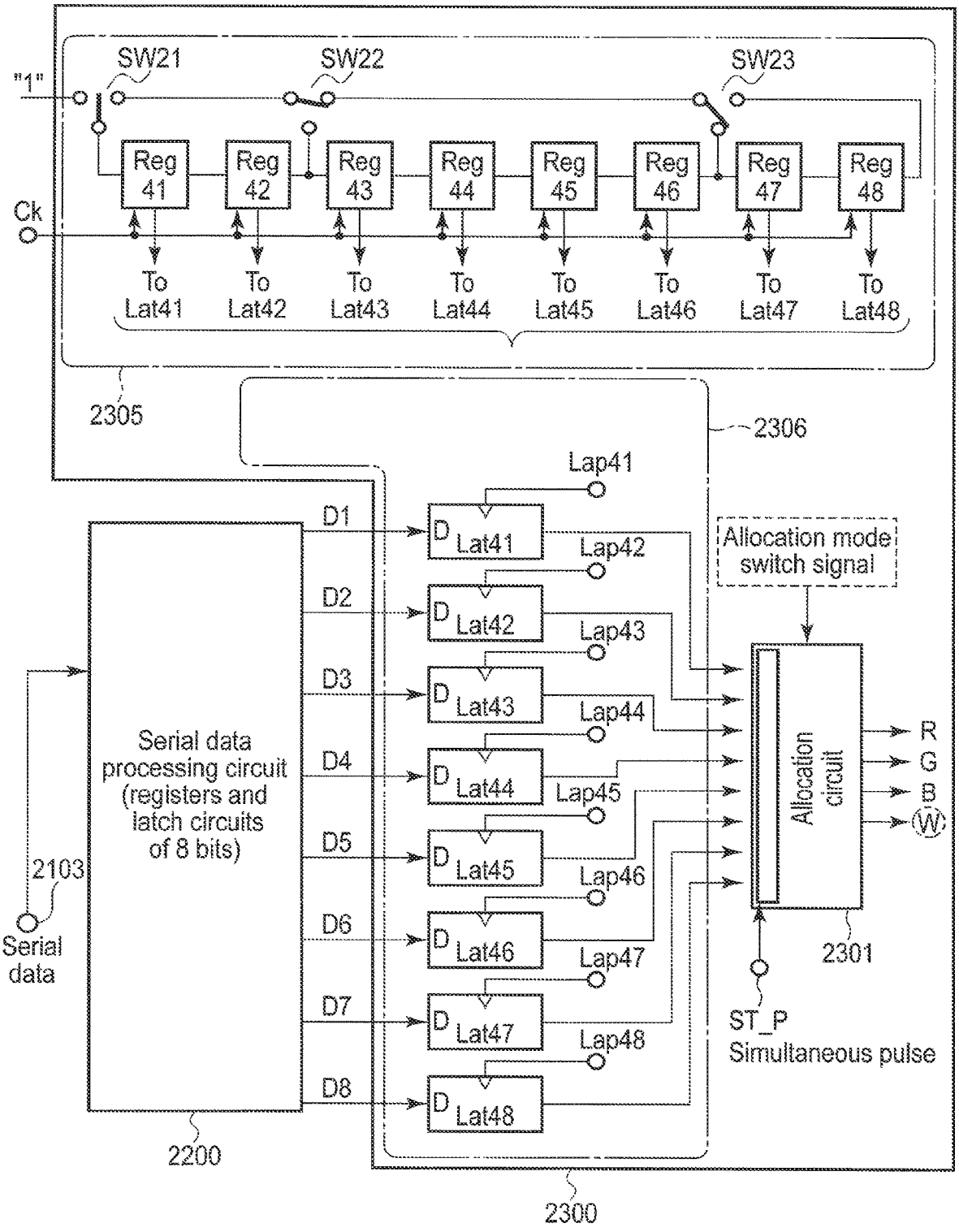
FIG. 17 shows an example of the structure of a data conversion module inside the signal supply circuit according to the embodiment.

FIG. 17 shows an example of the internal structure of the data conversion module 2300. The data conversion module 2300 includes a latch pulse generation circuit 2305 and a data latch circuit 2306.

Data items D1 to D8 obtained by serial-parallel conversion from the serial data processor 2200 are input to the data latch circuit 2306 of the data conversion module 2300.

Data items D1 to D8 can be latched by latch circuits Lat41 to Lat48. As latch pulses Lap41 to Lap48 for latch circuits Lat41 to Lat48, cyclic sampling pulses (latch pulses) generated by a plurality of registers Reg41 to Reg48 are used.

The circuit which generates latch pulses Lap41 to Lap48 includes registers Reg41 to Reg48 connected in series, switches SW21, SW22 and SW23, etc. Switch SW21 is a switch for setting a value of 1 to the first register Reg41 at the time of starting the generation of a latch pulse. Switch SW23 is a switch for feeding back the output of the last register Reg48 or the output of the sixth register Reg46 in accordance with the data mode. Switch SW22 is a switch for feeding back the output of the second register Reg42 or the output of switch SW23 to the first register Reg41.

When video data of a 4 bit-data mode is input, switches SW22 and SW23 are controlled so as to feed back the output of the last register Reg48 to the first register Reg41. In this way, latch circuits Lat41 to Lat48 cyclically latch input data items D1 to D8.

When video data of a 3 bit-data mode is input, switches SW22 and SW23 are controlled so as to feed back the output of the sixth register Reg46 to the first register Reg41. In this way, latch circuits Lat41 to Lat46 cyclically latch input data items D1 to D6. Neither data item D7 nor data item D8 is used.

When video data of a 1 bit-data mode is input, switches SW22 and SW23 are controlled so as to feed back the output of the second register Reg42 to the first register Reg41. In this way, latch circuits Lat41 and Lat42 cyclically latch input data items D1 and D2. None of data items D3 to D8 is used.

The latch data output from latch circuits Lat41 to Lat48 is input to the allocation (or distribution) circuit 2301. The allocation circuit 2301 is capable of allocating latch data (data items R, G and B, data items R, G, B and W, or a value of 1), etc., to an appropriate signal line S (S1 to Sm) in accordance with the type of the display panel. The allocation circuit 2301 allocates video data items R, G, B and W, etc., in accordance with the bit data mode of the video data determined in the mode control circuit 1103 and the form or type of the display panel used in the system. The allocation circuit 2301 is capable of simultaneously loading data from a group of latch circuits by a simultaneous pulse St_P. The simultaneous pulse St_P is also generated in the mode control circuit 1103 or the data analysis separation control circuit 2201.

The output of the allocation circuit 2301 (output parallel video data) is transmitted to subsequent latch circuits which hold data for a horizontal line. Specifically, the allocated data items (output parallel video data items) are output to a group of latch circuits which hold the data of subpixels for a horizontal line, and are simultaneously output to corresponding signal lines when the gate line to which the data items should be supplied is specified.

Figure 18:
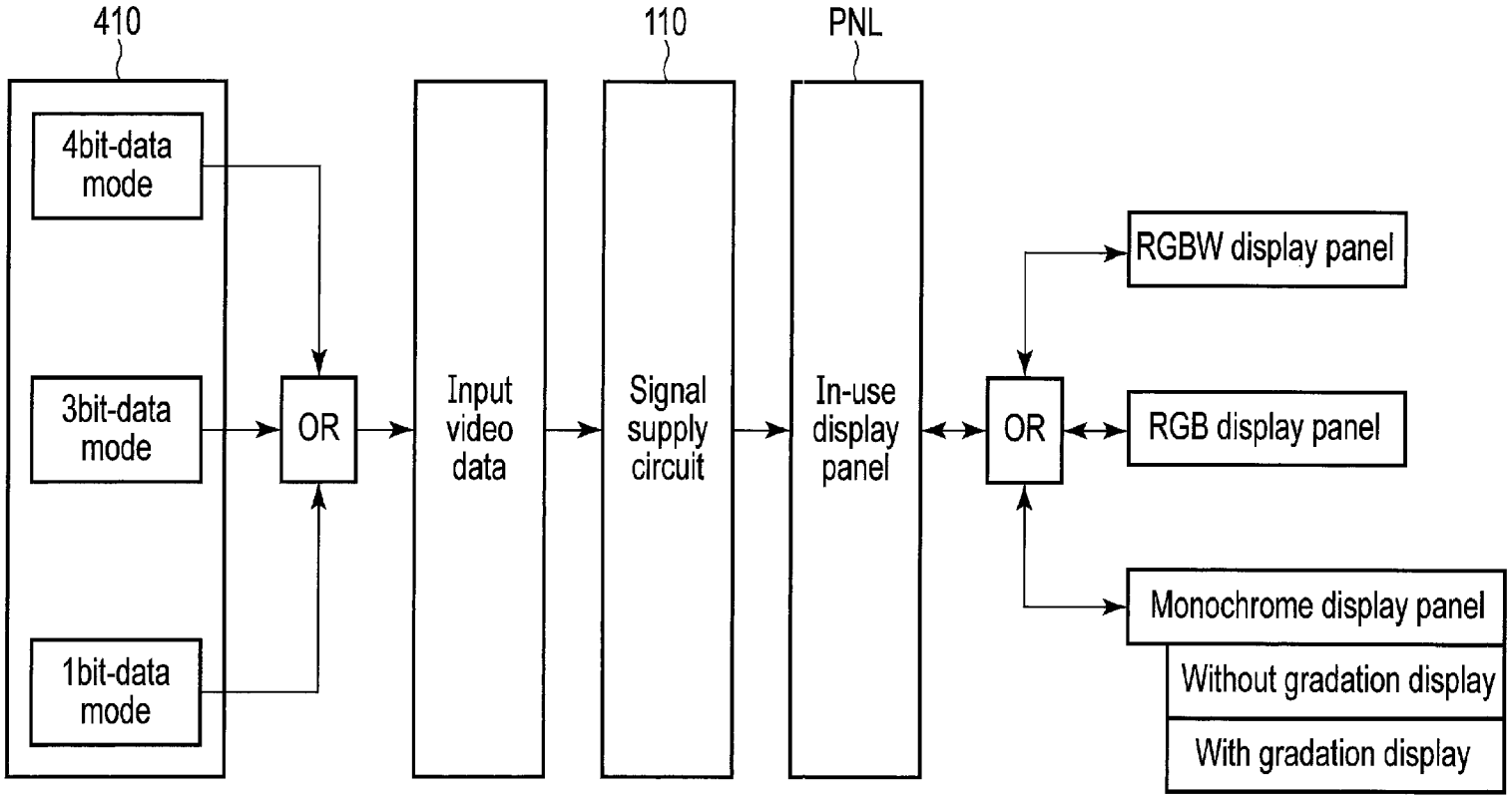
FIG. 18 is an explanatory diagram showing the types of the video data supply device and the display panel to which the signal supply circuit is adapted according to the embodiment.

FIG. 18 shows the types of modes of video data input from the video data supply device 410 to the signal supply circuit 110. The mode of video data may be a 4 bit-data mode, a 3 bit-data mode or a 1 bit-data mode as shown in FIG. 9 to FIG. 14.

As the type of the display panel which displays the video data output from the signal supply circuit 110, one of a display panel PNL comprising color filters R, G, B and W, a display panel PNL comprising color filters R, G and B, and a monochrome display panel PNL is operated based on user's selection. The monochrome display panel PNL may be a panel which performs gradation display, or a panel which does not perform gradation display.

Figure 19:
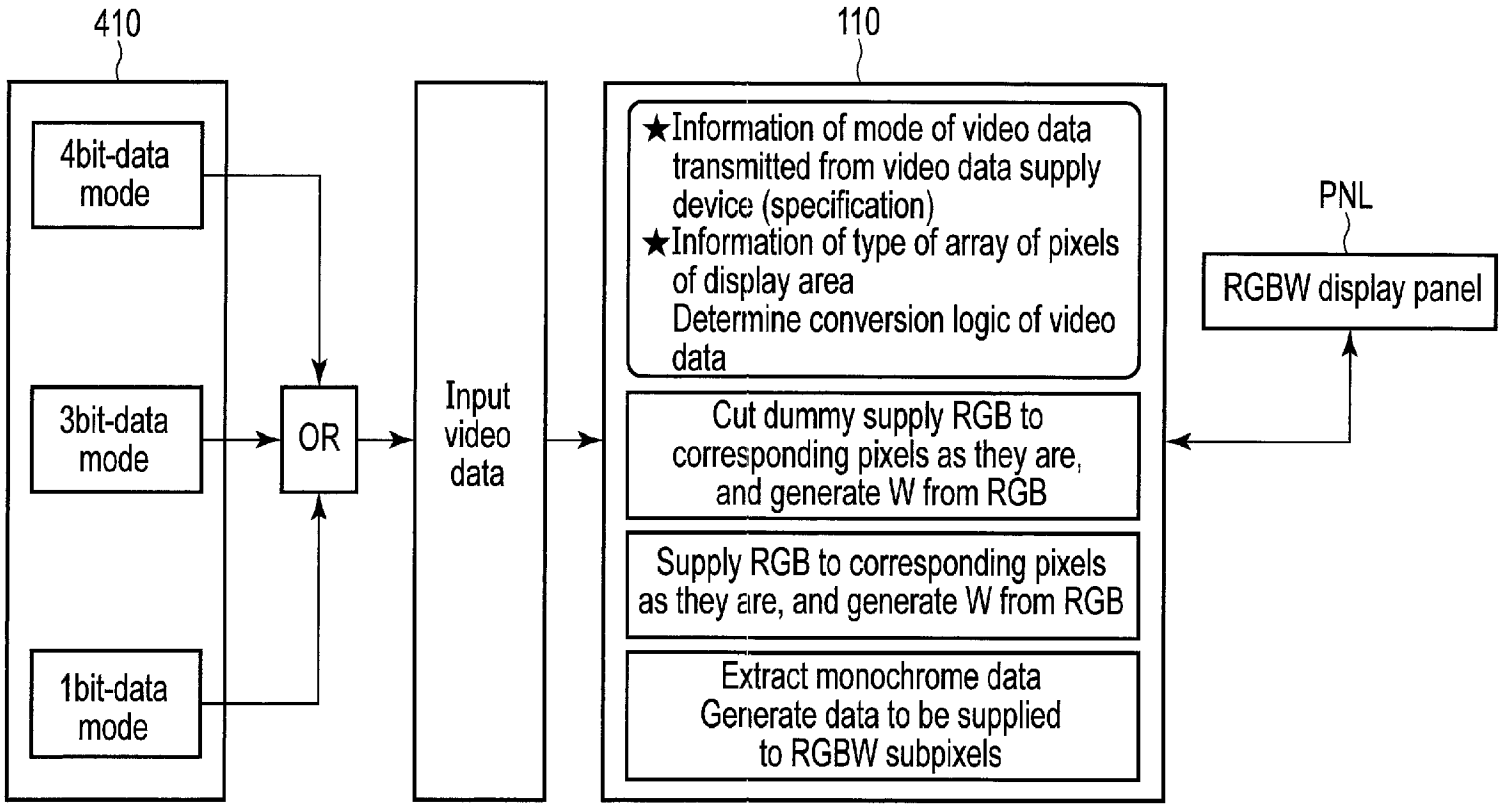
FIG. 19 is shown for explaining various processing modes of the signal supply circuit when a display panel comprising color filters R, G, B and W is employed in the embodiment.

FIG. 19 shows an example of a display device which employs a display panel PNL comprising color filters R, G, B and W. In this case, the signal supply circuit 110 is capable of converting the input video data in the following manner.

(A_4) When video data of a 4 bit-data mode (in other words, the video data shown in FIG. 13 and FIG. 14) is input, the signal supply circuit 110 cuts (discards) dummy data items and supplies data items R, G and B to corresponding pixels as they are. At this time, the serial data processing circuit 2200 of the signal supply circuit 110 applies serial-parallel conversion to all of serial data items D1 to D8 of 8 bits (see FIG. 16). The data latch circuit 2306 of the data conversion module 2300 cyclically latches all of serial data items D1 to D8 of 8 bits (see FIG. 17). The data conversion module 2300 creates the video data to be supplied to the pixels of filters W from adjacent data items R, G and B. For example, when all of the input data items R, G and B indicate a value of 1, or at least two of them indicate a value of 1, data items W of a value of 1 may be created.

(B_4) When video data of a 3 bit-data mode (in other words, the video data shown in FIG. 9 and FIG. 10) is input, the signal supply circuit 110 supplies data items R, G and B to corresponding pixels as they are. At this time, the serial data processing circuit 2200 of the signal supply circuit 110 applies serial-parallel conversion to serial data items D1 to D6 of 6 bits (see FIG. 16). The data latch circuit 2306 of the data conversion module 2300 cyclically latches serial data items D1 to D6 of 6 bits (see FIG. 17). In this case, video data items R, G and B are used to create a luminance data item W. In this way, it is possible to prepare the video data to be output to color filters R, G, B and W of the display panel PNL.

(C_4) When video data of a 1 bit-data mode (in other words, the video data shown in FIG. 11 and FIG. 12) is input, the signal supply circuit 110 supplies the video data to, for example, only the pixels of filters W. Alternatively, the signal supply circuit 110 supplies the video data to, for example, only the pixels of filters R, G or B (at this time, monochromatic display is performed in a single color R, B or G). Alternatively, the signal supply circuit 110 supplies a value of 1 to all of adjacent filters R, G, B and W or a value of 0 to all of adjacent filters R, G, B and W in accordance with the value of 1 or 0 of the video data. At this time, a combination of R, G, B and W corresponds to 1 bit of video data.

Figure 20:
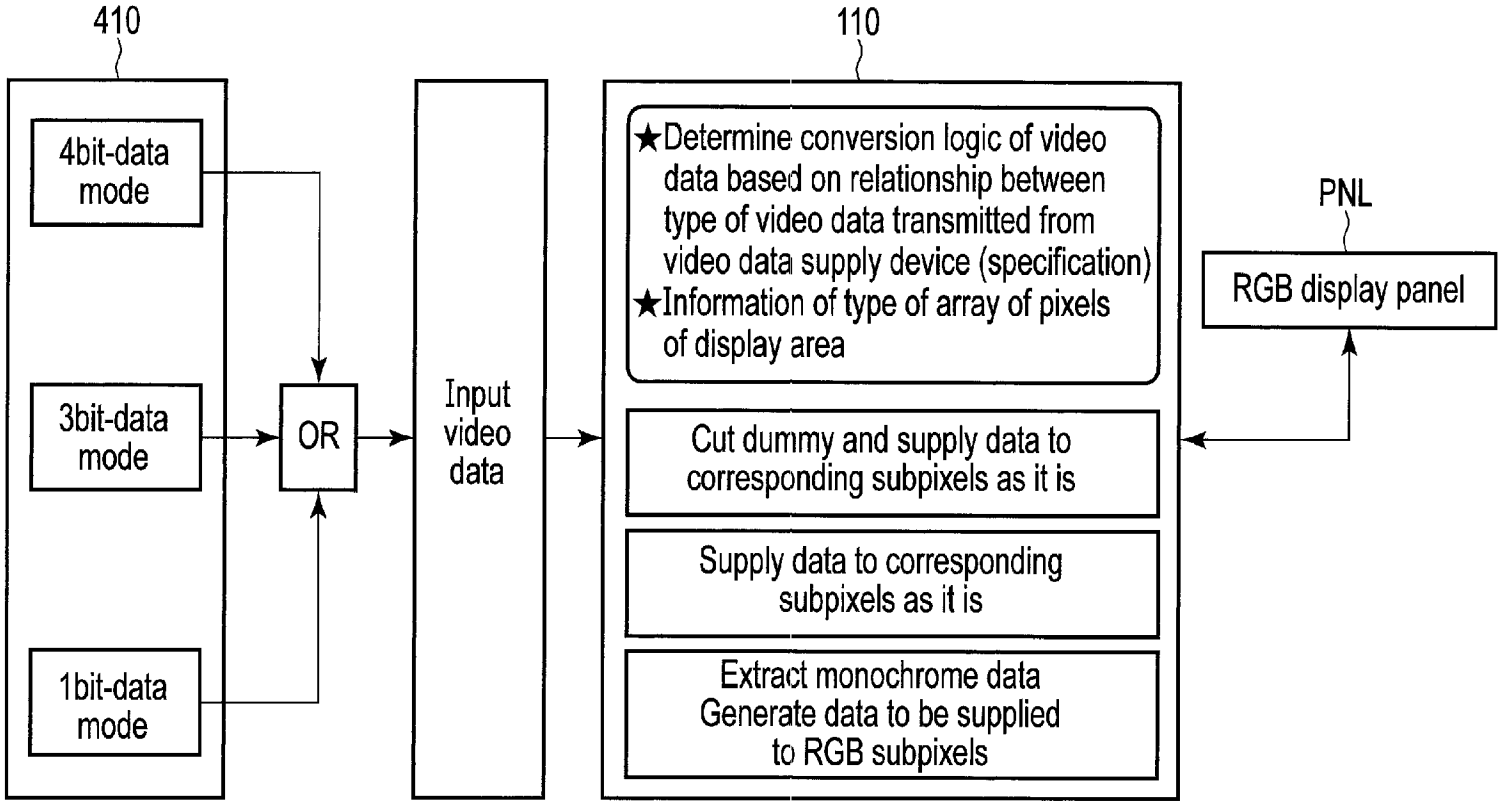
FIG. 20 is shown for explaining various processing modes of the signal supply circuit when a display panel comprising color filters R, G and B is employed in the embodiment.

FIG. 20 shows an example of a display device which employs a display panel PNL comprising color filters R, G and B. In this case, the signal supply circuit 110 is capable of converting the input video data in the following manner.

(A_3) When video data of a 4 bit-data mode (in other words, the video data shown in FIG. 13 and FIG. 14) is input, the signal supply circuit 110 cuts dummy data items and supplies data items R, G and B to corresponding pixels as they are. At this time, the serial data processing circuit 2200 of the signal supply circuit 110 applies serial-parallel conversion to serial data items D1 to D8 of 8 bits (see FIG. 16). The data latch circuit 2306 of the data conversion module 2300 cyclically latches serial data items D1 to D8 of 8 bits (see FIG. 17). It should be noted that dummy data items are cut in the allocation circuit 2301.

(B_3) When video data of a 3 bit-data mode (in other words, the video data shown in FIG. 9 and FIG. 10) is input, the signal supply circuit 110 supplies data items R, G and B to corresponding pixels as they are. At this time, the serial data processing circuit 2200 of the signal supply circuit 110 applies serial-parallel conversion to serial data items D1 to D6 of 6 bits (see FIG. 16). The data latch circuit 2306 of the data conversion module 2300 cyclically latches serial data items D1 to D6 of 6 bits (see FIG. 17).

(C_3) When video data of a 1 bit-data mode (in other words, the video data shown in FIG. 11 and FIG. 12) is input, the signal supply circuit 110 supplies the video data to, for example, the pixels of filters R, G or B (at this time, monochrome display is performed in a single color R, B or G). Alternatively, the signal supply circuit 110 supplies a value of 1 to all of adjacent filters R, G and B or a value of 0 to all of adjacent filters R, G and B in accordance with the value of 1 or 0 of the video data. At this time, a combination of R, G and B corresponds to 1 bit of video data.

Figure 21:
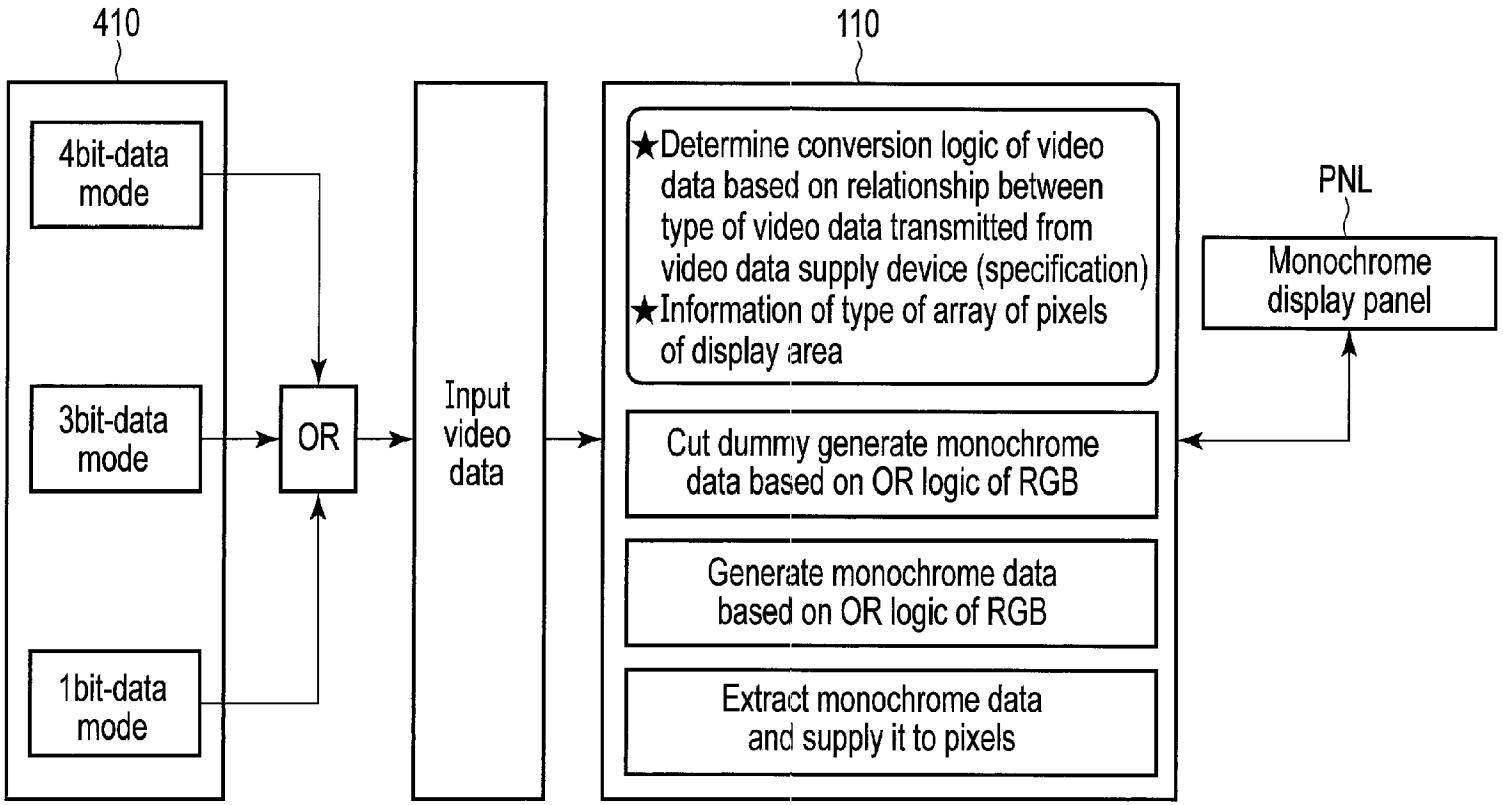
FIG. 21 is shown for explaining various processing modes of the signal supply circuit when a monochrome display panel is employed in the embodiment.

FIG. 21 shows an example of a display device which employs a monochrome display panel PNL. In this case, the signal supply circuit 110 is capable of converting the input video data in the following manner.

(A_1) When video data of a 4 bit-data mode (in other words, the video data shown in FIG. 13 and FIG. 14) is input, the signal supply circuit 110 cuts dummy data items and supplies data items R, G and B to monochrome pixels as they are. At this time, the serial data processing circuit 2200 of the signal supply circuit 110 applies serial-parallel conversion to serial data items D1 to D8 of 8 bits (see FIG. 16). The data latch circuit 2306 of the data conversion module 2300 cyclically latches serial data items D1 to D8 of 8 bits (see FIG. 17). It should be noted that the allocation circuit 2301 cuts (discards) dummy data items. In this mode, dummy data items are cut. Thus, three shades are applied. When each pixel comprises four subpixels (for example, subpixels R, G, B and W), and data items R, G, B and W are transferred, it is possible to display a monochrome image having four shades.

(B_1) When video data of a 3 bit-data mode (in other words, the video data shown in FIG. 9 and FIG. 10) is input, the signal supply circuit 110 supplies data items R, G and B to monochrome pixels as they are. At this time, the serial data processing circuit 2200 of the signal supply circuit 110 applies serial-parallel conversion to serial data items D1 to D6 of 6 bits (see FIG. 16). The data latch circuit 2306 of the data conversion module 2300 cyclically latches serial data items D1 to D6 of 6 bits (see FIG. 17).

(C_1) When video data of a 1 bit-data mode (in other words, the video data shown in FIG. 11 and FIG. 12) is input, the signal supply circuit 110 supplies the video data to pixels as they are.

The above process of the signal supply circuit 110 may be realized by hardware, or may be realized by controlling a memory and the reading/writing circuit of the memory by software.

Figure 22:
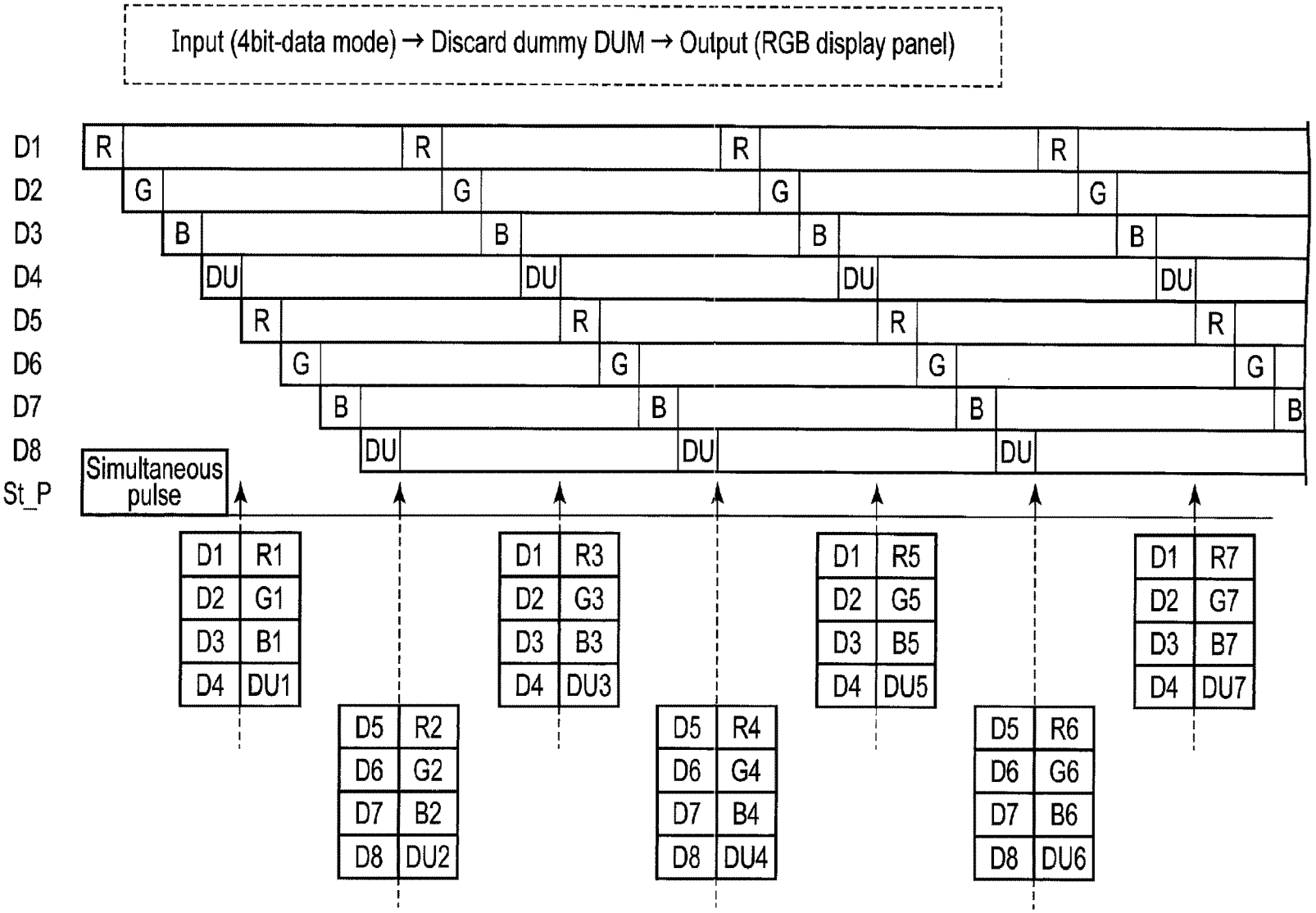
FIG. 22 is a timing chart shown for explaining operation in which parallel data items D1 to D8 are made simultaneous and loaded into an allocation circuit 2301 when video data of a 4 bit-data mode is supplied from the video data supply device in a display panel comprising color filters R, G and B in the embodiment.

FIG. 22 is a timing chart showing operation in which parallel data items D1 to D8 are made simultaneous and loaded into the allocation circuit 2301 when video data of a 4 bit-data mode is supplied from the video data supply device 410 in a display panel PNL comprising color filters R, G and B. In a 4 bit-data mode, video data items R, G, B and DU (dummy) are cyclically input to the signal supply circuit 110. Data items D1 to D8 are output from the serial data processing circuit 2200 in series. In this case, the data transfer route of the shift registers shown in FIG. 16 uses all of the eight registers Reg21 to Reg28. In other words, switch SW12 is controlled so as to select the output of register Reg28. Switch SW11 is controlled so as to select the output of switch SW12. The data transfer route of the shift registers shown in FIG. 17 uses eight registers Reg41 to Reg48. In other words, switch SW23 is controlled so as to select the output of register Reg48. Switch SW22 is controlled so as to select the output of switch SW23. Switch SW21 is controlled so as to select the output of switch SW22.

As shown in FIG. 17, data items D1 to D8 are latched by latch circuits Lat41 to Lat48 of the data conversion module 2300 in series. These data items are made simultaneous by the simultaneous pulse St_P in the input stage of the allocation circuit 2301.

A simultaneous pulse is applied after four data items are latched as shown in FIG. 22. Thus, four video data items R, G, B and DU are input to the allocation circuit 2301 as a unit. In the example of FIG. 22, four video data items R1, G1, B1 and DU1, four video data items R2, G2, B2 and DU2, four video data items R3, G3, B3 and DU3, . . . are sampled by the allocation circuit 2301 in series.

Dummy data items DU are discarded in the allocation circuit 2301.

Figure 23:
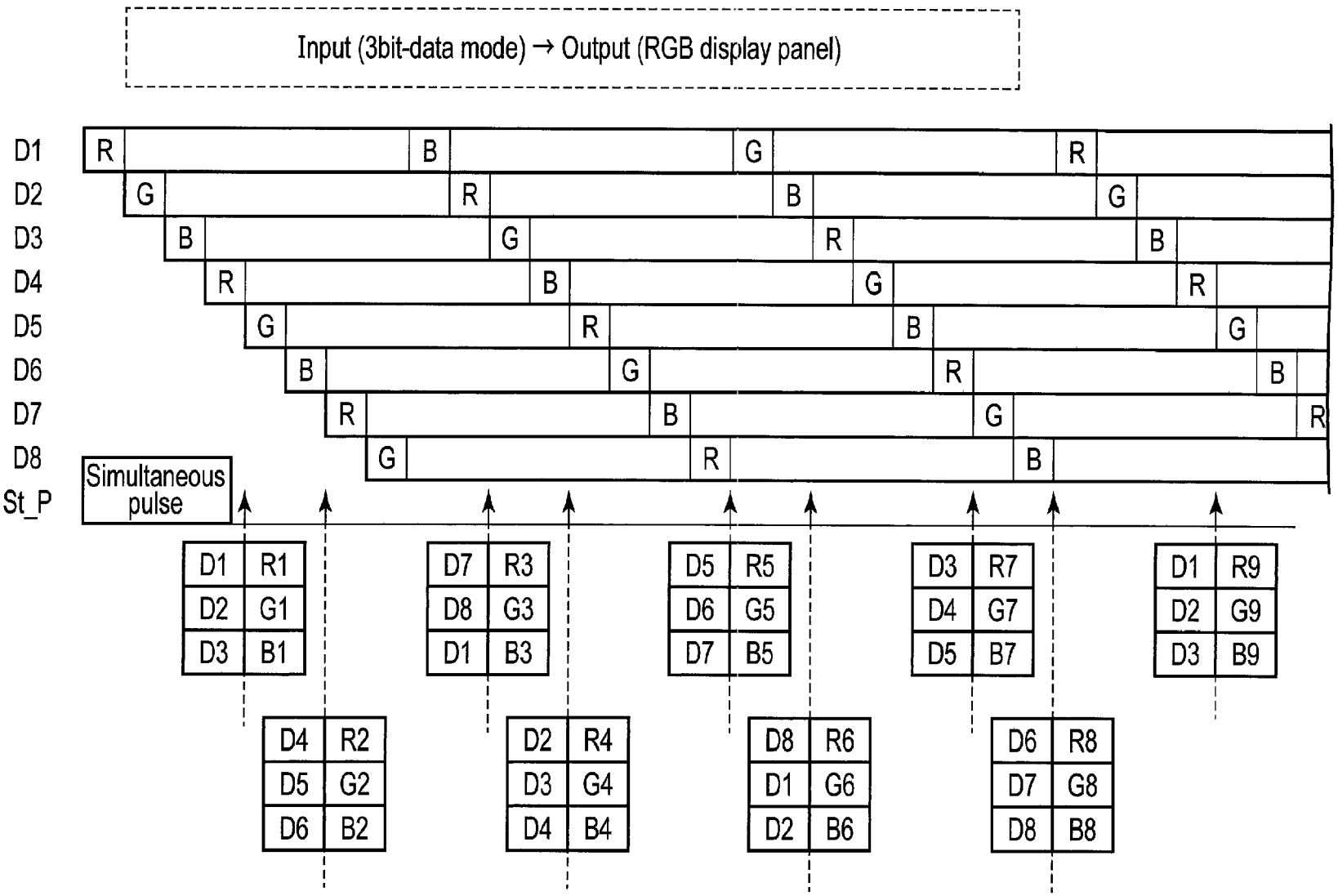
FIG. 23 is a timing chart shown for explaining operation in which parallel data items D1 to D8 are made simultaneous and loaded into the allocation circuit 2301 when video data of a 3 bit-data mode is supplied from the video data supply device in a display panel comprising color filters R, G and B in the embodiment.

FIG. 23 is a timing chart showing operation in which parallel data items D1 to D6 are made simultaneous and loaded into the allocation circuit 2301 when video data of a 3 bit-data mode is supplied from the video data supply device 410 in a display panel PNL comprising color filters R, G and B. In a 3 bit-data mode, video data items R, G and B are cyclically input to the signal supply circuit 110. Data items D1 to D6 are output from the serial data processing circuit 2200 in series. In this case, the data transfer route of the shift registers shown in FIG. 16 uses six registers Reg21 to Reg26. In other words, switch SW12 is controlled so as to select the output of register Reg26. Switch SW11 is controlled so as to select the output of switch SW12. Switch SW02 is controlled so as to select the output of switch SW11. The data transfer route of the shift registers shown in FIG. 17 uses six registers Reg41 to Reg46. In other words, switch SW23 is controlled so as to select the output of register Reg46. Switch SW22 is controlled so as to select the output of switch SW23. Switch SW21 is controlled so as to select the output of switch SW22.

As shown in FIG. 17, data items D1 to D6 are latched by latch circuits Lat41 to Lat46 of the data conversion module 2300 in series. These data items are made simultaneous by the simultaneous pulse St_P in the input stage of the allocation circuit 2301.

As shown in FIG. 23, for example, a simultaneous pulse is applied between received video data item R and subsequent video data item G and between received video data item B and subsequent video data item R. In this way, video data items D1=R1, D2=G1 and D3=B1, video data items D4=R2, D5=G2 and D6=B2, video data items D7=R3, D8=G3 and D1=B3, video data items D2=R4, D3=G4 and D4=B4, . . . are processed in the allocation circuit 2301 in series.

Figure 24:
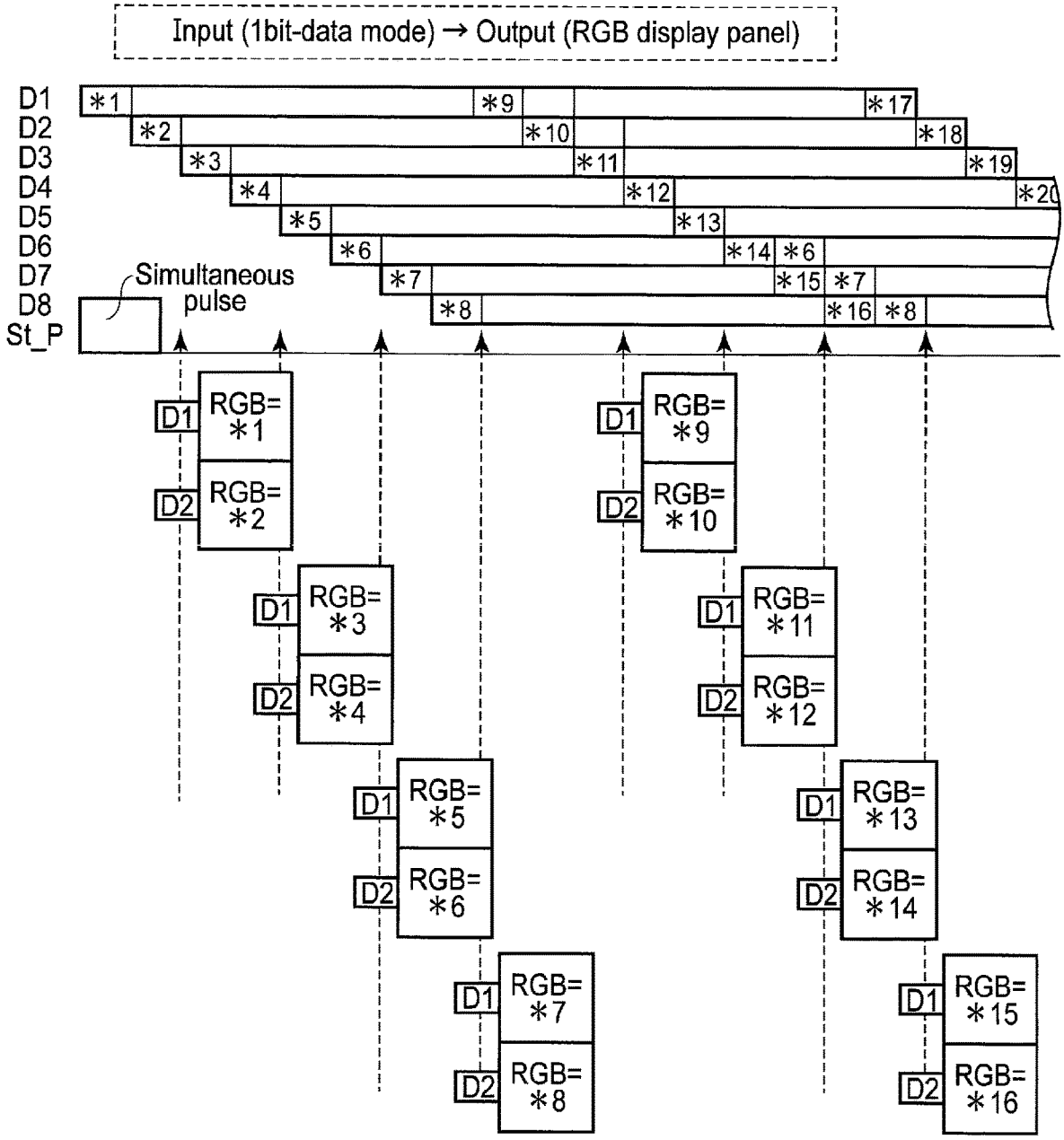
FIG. 24 is a timing chart shown for explaining operation in which parallel data items D1 to D8 are made simultaneous and loaded into the allocation circuit 2301 when video data of a 1 bit-data mode is supplied from the video data supply device in a display panel comprising color filters R, G and B in the embodiment.

FIG. 24 is a timing chart showing operation in which parallel data items D1 and D2 are made simultaneous and loaded into the allocation circuit 2301 when video data of a 1 bit-data mode is supplied from the video data supply device 410 in a display panel PNL comprising color filters R, G and B. In a 1 bit-data mode, serial video data (1 or 0) is cyclically input to the signal supply circuit 110 in a unit of 8 bits. In this case, data items D1 and D2 are output from the serial data processing circuit 2200 in series. The data transfer route of the shift registers shown in FIG. 16 uses two registers Reg21 and Reg22. Switch SW11 is controlled so as to select the output of register Reg22. Switch SW12 is arbitrary. The data transfer route of the shift registers shown in FIG. 17 uses two registers Reg41 and Reg42. In other words, switch SW22 is controlled so as to select the output of register Reg42. Switch SW23 is arbitrary.

As shown in FIG. 17, data items D1 and D2 are latched by latch circuits Lat41 and Lat42 of the data conversion module 2300 in series. These data items are made simultaneous by the simultaneous pulse St_P in the input stage of the allocation circuit 2301.

As shown in FIG. 24, a simultaneous pulse is supplied to the allocation circuit 2301 based on two received video data items.

The allocation circuit 2301 allocates data item D1=*1 to subpixels R, G and B, allocates subsequent data item D2=*2 to subsequent subpixels R, G and B, allocates subsequent data item D1=*3 to subsequent subpixels R, G and B, and allocates subsequent data item D2=*4 to subsequent subpixels R, G and B. In this way, data for one horizontal line is obtained in series.

Figure 25A:
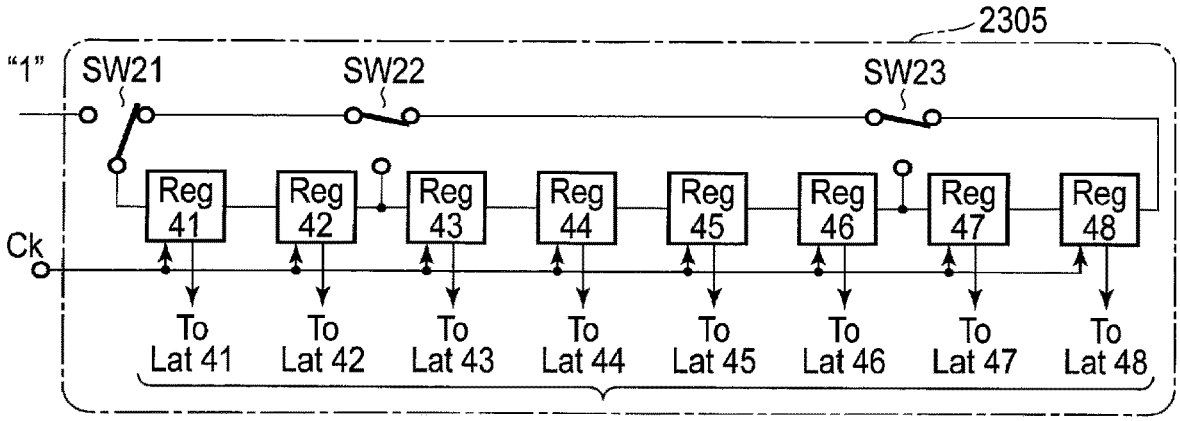
FIG. 25A shows an example of the shift data feedback route of shift registers Reg41 to Reg48 inside a latch pulse generation circuit 2305 when the data conversion process shown in FIG. 22 is performed.
Figure 25B:
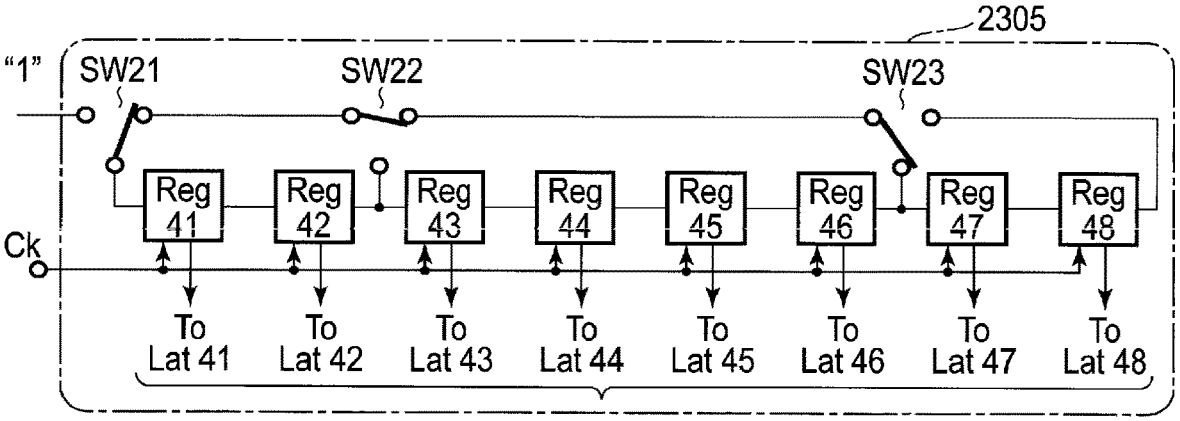
FIG. 25B shows an example of the shift data feedback route of shift registers Reg41 to Reg48 inside the latch pulse generation circuit 2305 when the data conversion process shown in FIG. 23 is performed.
Figure 25C:
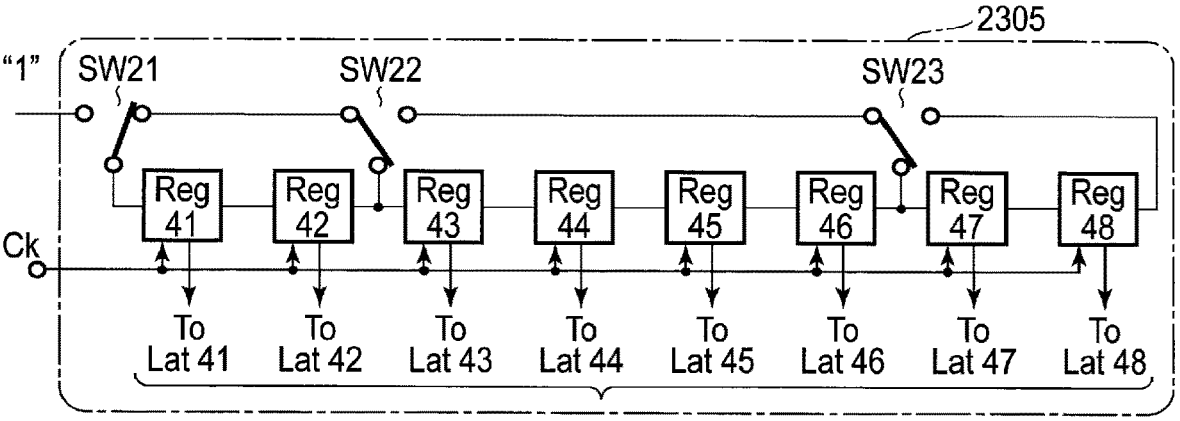
FIG. 25C shows an example of the shift data feedback route of shift registers Reg41 to Reg48 inside the latch pulse generation circuit 2305 when the data conversion process shown in FIG. 24 is performed.

FIG. 25A, FIG. 25B and FIG. 25C show examples of shift data feedback routes of shift registers Reg41 to Reg48 inside the latch pulse generation circuit 2305 when the data conversion processes shown in FIG. 22, FIG. 23 and FIG. 24 are performed, respectively. The states of switches SW22 and SW23 of the shift data feedback route differ among FIG. 25A, FIG. 25B and FIG. 25C. However, the explanation of switches SW22 and SW23 is omitted here since it is made with respect to FIG. 22, FIG. 23 and FIG. 24.

The number of lines of shift registers Reg41 to Reg48 is not limited to one. They may be arranged such that the width of the arrangement area is reduced. For example, shift registers Reg41 to Reg44 may be arranged in the first line. Shift registers Reg44 to Reg48 may be arranged in the second line.

Figure 26:
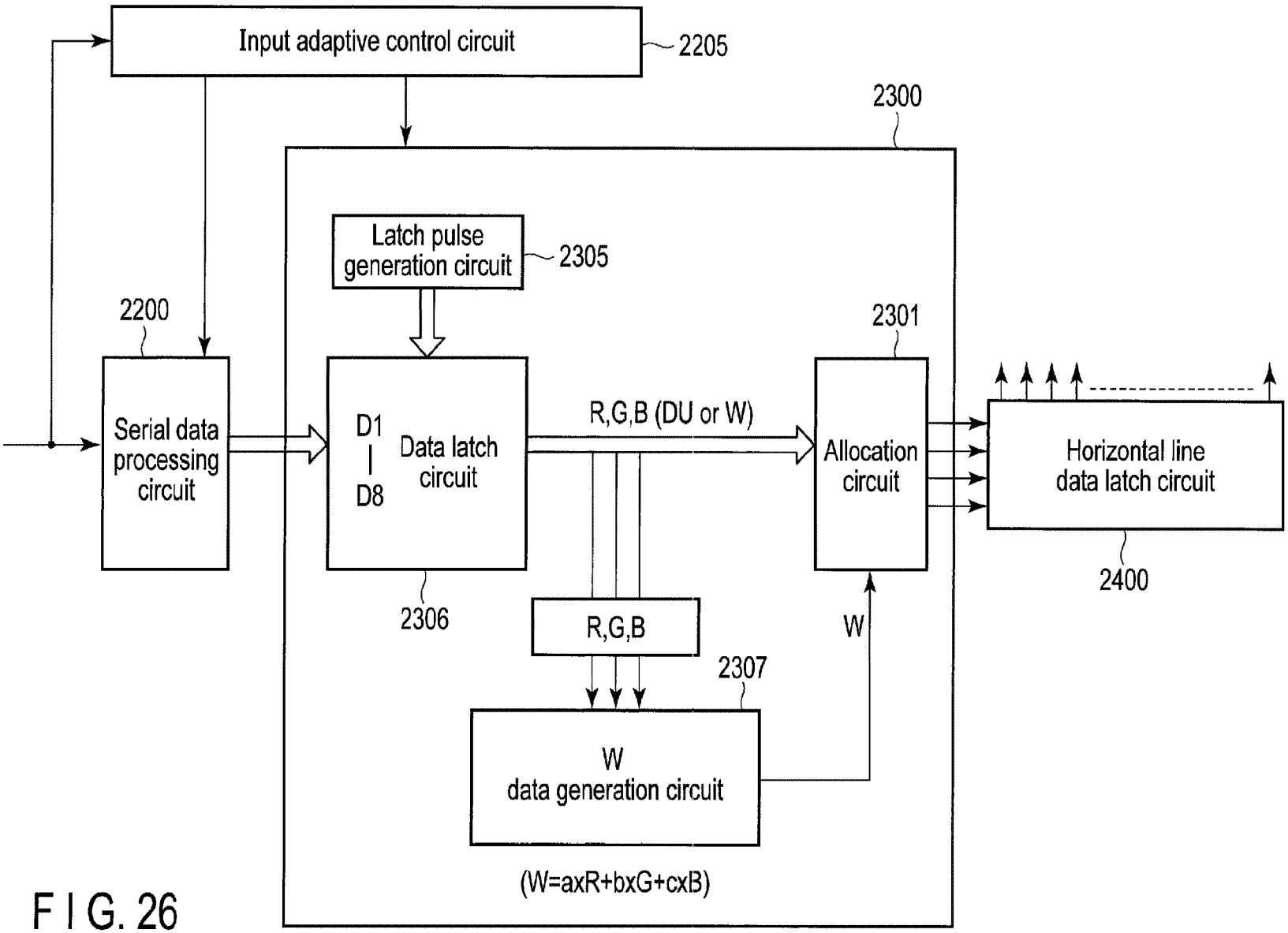
FIG. 26 shows an embodiment in which a W data generation circuit 2307 is further provided in the data conversion module 2300.

FIG. 26 shows another embodiment in which a W data generation circuit 2307 is further provided in the data conversion module 2300. It is possible to generate data item W equivalent to luminance, using video data items R, G and B output from the data latch circuit 2306. For example, video data item W can be obtained by multiplying video data items R, G and B by coefficients a, b and c, respectively, and adding them as shown in the following equation.

$$W=a\times R+b\times G+c\times B$$

Video data item W is allocated to an appropriate subpixel W by the allocation circuit 2301. The allocated video data item is held by a horizontal line data latch circuit 2400. Video data items are concurrently output to the specified horizontal lines via signal lines at the right time.

The W data generation circuit 2307 is effective when the video data supply device 410 supplies video data items R, G and B, and a display panel PNL comprising subpixels R, G, B and W is employed. This structure is effective since the output of the W data generation circuit 2307 can be used for subpixels W.

When the video data supply device 410 supplies video data items R, G, B and W, the operation of the W data generation circuit 2307 is stopped.

The present invention is not limited to the above embodiments. When the display panel comprises cyan, magenta and blue elements, a circuit which converts video data items R, G and B output from the data latch circuit 2306 into cyan, magenta and blue data items may be provided.

The above embodiments include specific structures in many respects as follows.

(1) According to one embodiment, a signal supply circuit is used for a display panel comprising a plurality of subpixels each comprising a memory. The signal supply circuit comprises a first mode. The first mode receives first video data in a unit of n bits corresponding to the subpixels from outside, and supplies digital data for the subpixels in a unit of m bits less than n bits to the subpixels based on the first video data.

(2) In the signal supply circuit of item (1), the first video data is serial data. The signal supply circuit comprises a parallel conversion module which parallelly converts the serial data into digital data corresponding to the subpixels. The parallel conversion module converts the first video data of n bits into data of m bits.

(3) In the signal supply circuit of item (1) or (2), the number of latch circuits may be three or six. The first video data is serial data. The signal supply circuit comprises a parallel conversion module which parallelly converts the serial data into digital data corresponding to the subpixels. The parallel conversion module comprises a plurality of latch circuits. The number of latch circuits used for the parallel conversion is an integral multiple of m, excluding multiplication by zero.

(4) In the signal supply circuit of any one of items (1) to (3), the number of latch circuits to be used may be six, and the number of subpixels may be three. The number of subpixels included in each pixel is less than m, and is one.

(5) In the signal supply circuit of any one of items (1) to (4), dummy video data is included in the first video data of the first mode.

(6) The signal supply circuit of item (1) comprises a second mode as a monochrome mode. The second mode receives second video data of n bits corresponding to the subpixels from outside, and supplies k digital data items for the subpixels to the subpixels based on the second video data, where k is greater than n.

(7) In the second mode of the signal supply circuit of item (6), the parallel conversion module parallelly converts the first video data of m bits into a single video data item.

(8) In the signal supply circuit of item (6), n is not a multiple of one, and is preferably eight, and m is preferably three or six. Further, n is not a multiple of three.

(9) The signal supply circuit of item (1) comprises a data input adaptive control circuit 2205 which obtains at least a command and a data sectional signal from external serial data, and a serial data processing circuit 2200 which separates the video data transmitted from outside into parallel data in accordance with the data sectional signal from the input adaptive control circuit 2205.

(10) The signal supply circuit of item (9) further comprises a mode control circuit 1103 which switches an operation mode in accordance with the command.

(11) According to one embodiment, a display device comprises a serial data processing circuit 2200, a data conversion module 2300 and an input adaptive control circuit 2205. The serial data processing circuit 2200 is supplied with serial data, applies parallel conversion to serial video data included in the serial data, and outputs parallel video data. The data conversion module 2300 obtains output parallel video data by latching the parallel video data and allocating the data to corresponding subpixels arranged on the display panel. The input adaptive control circuit 2205 controls the parallel conversion operation of the serial data processing circuit 2200 and the latch process and the allocation process of the data conversion module 2300 in accordance with type information of a layout of the subpixels of the display panel and a mode of the serial video data included in the serial data.

(12) In the display device of item (11), the number of bits of the serial video data included in the serial data is eight. The data conversion module 2300 outputs the output parallel video data obtained by the allocation process in a unit less than 8 bits.

(13) In the display device of item (11), the serial video data is 4 bit-data mode including red (R), green (G), blue (B) and a dummy (DUM). Alternatively, the serial video data is 3 bit-data mode including red (R), green (G) and blue (B). Alternatively, the serial video data is 1 bit-data mode including 1 and 0.

(14) In the display device of item (13), the serial data includes a mode table indicating that the mode of the serial video data is a 4 bit-data mode, a 3 bit-data mode or a 1 bit-data mode.

(15) In the display device of item (13), the serial data includes address data indicating a write destination of the parallel video data.

(16) In the display device of item (13), when the display panel comprises an array of red (R), green (G) and blue (B) subpixels, and the mode of the serial video data is a 4 bit-data mode including red (R), green (G), blue (B) and dummy (DUM) video data items, the data conversion module 2300 discards the dummy (DUM) video data item, and outputs the red (R), green (G) and blue (B) video data items as the output parallel video data in the allocation process.

(17) In the display device of item (13), when the display panel comprises an array of red (R), green (G) and blue (B) subpixels, and the mode of the serial video data is a 3 bit-data mode including red (R), green (G) and blue (B) video data items, the data conversion module 2300 outputs the red (R), green (G) and blue (B) video data items as the output parallel video data in the allocation process.

(18) In the display device of item (13), when the display panel comprises an array of red (R), green (G) and blue (B) subpixels, and the mode of the video data is a 1 bit-data mode including 1 and 0, the data conversion module 2300 outputs 1 bit of video data as the output parallel video data in the allocation process.

(19) In the display device of item (13), when the display panel comprises an array of monochrome pixels, and the mode of the serial video data is a 4 bit-data mode including red (R), green (G), blue (B) and dummy (DUM) video data items, the data conversion module 2300 discards the dummy (DUM) video data item and outputs the red (R), green (G) and blue (B) video data items to the monochrome pixels of the array in the allocation process.

(20) In the display device of item (13), when the display panel comprises an array of monochrome pixels, and the mode of the serial video data is a 3 bit-data mode including red (R), green (G) and blue (B) video data items, the data conversion module 2300 outputs the red (R), green (G) and blue (B) video data items to the monochrome pixels of the array in the allocation process.

(21) In the display device of item (13), when the display panel comprises an array of monochrome pixels, and the mode of the serial video data is a 1 bit-data mode including 1 and 0, the data conversion module 2300 outputs 1 bit of serial video data to the monochrome pixels of the array in the allocation process.

(22) In the display device of item (13), when the display panel comprises an array of red (R), green (G), blue (B) and white (W) subpixels, and the mode of the serial video data is a 4 bit-data mode including red (R), green (G), blue (B) and dummy (DUM) video data items, the data conversion module 2300 discards the dummy (DUM) video data item and outputs the red (R), green (G) and blue (B) video data items and a white (W) video data item generated by using the red (R), green (G) and blue (B) video data items as the output parallel video data in the allocation process.

(23) In the display device of item (13), when the display panel comprises an array of red (R), green (G), blue (B) and white (W) subpixels, and the mode of the serial video data is a 3 bit-data mode including red (R), green (G) and blue (B) video data items, the data conversion module 2300 outputs the red (R), green (G) and blue (B) video data items and a white (W) video data item generated by using the red (R), green (G) and blue (B) video data items as the output parallel video data in the allocation process.

(24) In the display device of item (13), when the display panel comprises an array of monochrome pixels, and the mode of the video data is a 1 bit-data mode including 1 and 0, the data conversion module 2300 outputs 1 bit of video data for the array of monochrome pixels in the allocation process.

(25) In the display device of item (11), the input adaptive control circuit 2205 comprises an input terminal for inputting a type of the display panel, and an input terminal for inputting identification information of the bit data mode (a 4 bit-data mode, a 3 bit-data mode or a 1 bit-data mode) of the serial video data.

(26) One embodiment provides a data processing method of a signal supply circuit. The signal supply circuit comprises a serial data processing circuit which samples serial video data included in serial data, a data conversion module which converts parallel video data transmitted from the serial data processing circuit into data for a display panel, and an input adaptive control circuit which controls the serial data processing circuit and the data conversion module. The input adaptive control circuit controls a parallel conversion sampling mode of the serial data processing circuit 2200 in accordance with a bit data mode of the serial video data included in the serial data. The input adaptive control circuit obtains output parallel video data by allocating the parallel video data from the serial data processing circuit to corresponding subpixels arranged on the display panel in accordance with type information of an array of the subpixels of the display panel.

(27) In the data processing method of item (26), a unit of the serial video data included in the serial data is 8 bits. The input adaptive control circuit performs control such that the data conversion module 2300 outputs the output parallel video data in a unit less than 8 bits.

(28) In the data processing method of item (26), the input adaptive control circuit specifies whether the serial video data is 4 bit-data mode including red (R), green (G), blue (B) and a dummy (DUM), 3 bit-data mode including red (R), green (G) and blue (B), or 1 bit-data mode including 1 and 0.

(29) In the data processing method of item (28), the input adaptive control circuit specifies whether a mode of the serial video data is a 4 bit-data mode, a 3 bit-data mode or a 1 bit-data mode, using a mode table included in the serial data.

(30) In the data processing method of item (26), the input adaptive control circuit determines address data included in the serial data and indicating a write destination of the parallel video data.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A signal supply circuit used for a display panel comprising a plurality of subpixels each comprising a memory, the signal supply circuit comprising:

a latch circuit receiving a serial data as a first video data, a register circuit outputting a latch pulse to the latch circuit, a parallel conversion circuit converting the serial data latched by the latch circuit to a parallel digital data, an allocation circuit allocating the parallel digital data to each of the subpixels, and an input adaptive control circuit receiving identification information of the display panel from outside the display panel, wherein in a first mode, the register circuit outputs n cyclic latch pulses to the latch circuit for receiving the first video data in a unit of n bits from outside the display panel, when a unit of m bits corresponds to the subpixels in the first mode, the allocation circuit cuts parallel digital data that does not correspond to the subpixels and supplies parallel digital data for the unit of m bits corresponding to the subpixels based on the identification information from the input adaptive control circuit, and wherein n>m.

2. The signal supply circuit of claim 1, wherein dummy video data is included in the first video data of the first mode.

3. The signal supply circuit of claim 1, further comprising a second mode, wherein the second mode is a mode which receives second video data corresponding to the subpixels in a unit of n bits from outside, and supplies digital data for the subpixels to the subpixels, and the digital data is obtained by change to a unit of k bits corresponding to the subpixels based on the second video data.

4. The signal supply circuit of claim 1, further comprising:

a data input adaptive control circuit which obtains at least a command and a data sectional signal from external serial data; and a serial data processing circuit which separates the first video data transmitted from the outside into parallel data in accordance with the data sectional signal from the input adaptive control circuit.

5. The signal supply circuit of claim 4, further comprising a mode control circuit which switches an operation mode in accordance with the command.

6. A display device comprising:

a plurality of subpixels arranged on a display area of a display panel and each comprising a memory;

a serial data processing circuit arranged on the display panel and which is supplied with serial data, applies parallel conversion to serial video data included in the serial data, and outputs parallel video data;

a data conversion circuit which obtains the output parallel video data by latching the parallel video data and allocating the latched data to corresponding subpixels of the display panel in an allocation process; and an input adaptive control circuit which controls the parallel conversion operation of the serial data processing circuit and latch timing and a form of the allocation process of the data conversion circuit in accordance with type information of a layout of the subpixels of the display panel and a mode of the serial video data included in the serial data, wherein the serial data processing circuit comprises register circuits and latch circuits, the register circuits circulate at least a cyclic latch pulse, a number of the cyclic latch pulse is determined in accordance with the mode of the serial video data, the latch circuits output the parallel video data to the data conversion circuit based on each latch cyclic latch pulse from the register circuits, the data conversion circuit comprises an allocation circuit, the allocation circuit changes and outputs the output parallel video data in accordance with the type information of the layout of the subpixels of the display panel and a mode table of the serial video data included in the serial data, and the mode table indicates that the mode of the serial video data is one of: a 4 bit-data mode, a 3 bit-data mode, a 1 bit-data mode.

7. The display device of claim 6, wherein the number of bits of the serial video data included in the serial data is eight, and the data conversion circuit cuts output parallel video data that does not correspond to the subpixels and outputs the allocated output parallel video data in a unit less than 8 bits.

8. The display device of claim 6, wherein the serial video data of the serial data is Obit-data mode including red (R), green (G), blue (B) and a dummy (DUM), 3 bit-data mode including red (R), green (G) and blue (B), or 1 bit-data mode including 1 and 0.

9. The display device of claim 6, wherein the serial data includes address data indicating a write destination of the parallel video data.

10. The display device of claim 6, wherein when the display panel comprises an array of red (R), green (G) and blue (B) subpixels, and the mode of the serial video data is a 4 bit-data mode including red (R), green (G), blue (B) and dummy (DUM) video data items, the data conversion circuit discards the dummy (DUM) video data item and outputs the red (R), green (G) and blue (B) video data items as the output parallel video data in the allocation process.

11. The display device of claim 6, wherein when the display panel comprises an array of red (R), green (G) and blue (B) subpixels, and the mode of the serial video data is a 3 bit-data mode including red (R), green (G) and blue (B) video data items, the data conversion circuit outputs the red (R), green (G) and blue (B) video data items as the output parallel video data in the allocation process.

12. The display device of claim 6, wherein when the display panel comprises an array of red (R), green (G), blue (B) and white (W) subpixels, and the mode of the serial video data is a 3 bit-data mode including red (R), green (G) and blue (B) video data items, the data conversion circuit generates a video data item corresponding to white (W) from the red (R), green (G) and blue (B) video data items, and outputs the red (R), green (G), blue (B) and white (W) video data items as the output parallel video data in the allocation process.

13. The display device of claim 6, wherein when the display panel comprises an array of red (R), green (G) and blue (B) subpixels, and the mode of the serial video data is a 1 bit-data mode including 1 and 0, the data conversion circuit outputs 1 bit of serial video data as the output parallel video data in the allocation process.

14. The display device of claim 6, wherein the serial data is supplied from a video data supply device to the serial data processing circuit wirelessly or via a line.

* * * * *